US007602921B2

(12) United States Patent
Iida et al.

(10) Patent No.: US 7,602,921 B2
(45) Date of Patent: Oct. 13, 2009

(54) SOUND IMAGE LOCALIZER

(75) Inventors: Kazuhiro Iida, Yokohama (JP); Kazuhiro Nakamura, Yokohama (JP)

(73) Assignee: Panasonic Corporation, Osaka (JP)

( * ) Notice: Subject to any disclaimer, the term of this patent is extended or adjusted under 35 U.S.C. 154(b) by 378 days.

(21) Appl. No.: 10/484,307

(22) PCT Filed: Jul. 17, 2002

(86) PCT No.: PCT/JP02/07241

§ 371 (c)(1),
(2), (4) Date: Jan. 20, 2004

(87) PCT Pub. No.: WO03/009643

PCT Pub. Date: Jan. 30, 2003

(65) Prior Publication Data

US 2004/0196991 A1 Oct. 7, 2004

(30) Foreign Application Priority Data

Jul. 19, 2001 (JP) ..... 2001-219512
May 2, 2002 (JP) ..... 2002-130825

(51) Int. Cl.
*H04R 5/00* (2006.01)

(52) U.S. Cl. ..... 381/17

(58) Field of Classification Search ..... 381/17–19, 381/1, 300, 309–310, 74, 61, 63; 84/600–602, 84/626

See application file for complete search history.

(56) References Cited

U.S. PATENT DOCUMENTS 4,817,149 A * 3/1989 Myers ..... 381/1
5,521,981 A * 5/1996 Gehring ..... 381/17
5,742,689 A 4/1998 Tucker et al.
5,822,438 A * 10/1998 Sekine et al. ..... 381/17

(Continued)

FOREIGN PATENT DOCUMENTS

JP 5-252597 9/1993

OTHER PUBLICATIONS

European Search Report.

*Primary Examiner*—Vivian Chin
*Assistant Examiner*—Lun-See Lao
(74) *Attorney, Agent, or Firm*—Pearne & Gordon LLP

(57) ABSTRACT

The present invention relates to a sound image localizing apparatus for generating a sound image localized in an arbitrarily set three-dimensional direction. The sound image direction setting unit (111) is operable to set a three-dimensional direction to which the sound image is to be localized in accordance with a listener's instruction; the angle conversion unit (112) is operable to convert the direction into a lateral angle (α) and a rising angle (β), each of which serves as a cue for the listener to perceive the direction. The convolution operation unit 116 is operable to obtain lateral angle control information corresponding to the lateral angle (α) from the lateral angle control information storage unit (113), a listener's front direction head-related impulse response from the front direction head-related impulse response storage unit (115), and rising angle difference information corresponding to the rising angle (β) from the rising angle difference information storage unit (114). The convolution operation unit 116 is then operable to convolute the sound source signal with the lateral angle control information, the front direction head-related impulse response, and the rising angle difference information, and output the operation result.

7 Claims, 19 Drawing Sheets

U.S. PATENT DOCUMENTS 5,982,903 A * 11/1999 Kinoshita et al. ..... 381/18
6,078,669 A 6/2000 Maher
6,421,446 B1 * 7/2002 Cashion et al. ..... 381/17
7,167,567 B1 * 1/2007 Sibbald et al. ..... 381/17
7,197,151 B1 * 3/2007 Sibbald et al. ..... 381/17

* cited by examiner

FIG.2

| Lateral Angle (° ) | Interaural Time Differences (μs) |
|---|---|
| 0 | 687.4 |
| 10 | 645.7 |
| 20 | 583.2 |
| 30 | 499.9 |
| 40 | 416.6 |
| 50 | 333.3 |
| 60 | 250.0 |
| 70 | 166.6 |
| 80 | 83.3 |
| 90 | 0.0 |
| 100 | −83.3 |
| 110 | −166.6 |
| 120 | −250.0 |
| 130 | −333.3 |
| 140 | −416.6 |
| 150 | −499.9 |
| 160 | −583.2 |
| 170 | −645.7 |
| 180 | −687.4 |

Positive : Right Ear Precedent to Left Ear,
Negative : Left Ear Precedent to Right Ear

FIG.3

| Lateral Angle (° ) | Interaural Sound Level Differences (dB) |
|---|---|
| 0 | 11.5 |
| 10 | 11.5 |
| 20 | 12.0 |
| 30 | 12.5 |
| 40 | 11.5 |
| 50 | 10.5 |
| 60 | 9.5 |
| 70 | 6.5 |
| 80 | 3.5 |
| 90 | 0.0 |
| 100 | −3.5 |
| 110 | −6.5 |
| 120 | −9.5 |
| 130 | −10.5 |
| 140 | −11.5 |
| 150 | −12.5 |
| 160 | −12.0 |
| 170 | −11.5 |
| 180 | −11.5 |

Positive : Sound Level Audible to Right Ear is Greater,
Negative : Sound Level Audible to Left Ear is Greater

FIG.4

| Lateral Angle (° ) | Interaural Time Differences (μs) | Interaural Sound Level Differences (dB) |
|---|---|---|
| 0 | 687.4 | 11.5 |
| 10 | 645.7 | 11.5 |
| 20 | 583.2 | 12.0 |
| 30 | 499.9 | 12.5 |
| 40 | 416.6 | 11.5 |
| 50 | 333.3 | 10.5 |
| 60 | 250.0 | 9.5 |
| 70 | 166.6 | 6.5 |
| 80 | 83.3 | 3.5 |
| 90 | 0.0 | 0.0 |
| 100 | −83.3 | −3.5 |
| 110 | −166.6 | −6.5 |
| 120 | −250.0 | −9.5 |
| 130 | −333.3 | −10.5 |
| 140 | −416.6 | −11.5 |
| 150 | −499.9 | −12.5 |
| 160 | −583.2 | −12.0 |
| 170 | −645.7 | −11.5 |
| 180 | −687.4 | −11.5 |
| | Positive : Right Ear Precedent , Negative : Left Ear Precedent | Positive : Right Ear Greater, Negative : Left Ear Greater |

FIG.5

| Rising Angle (° ) | Differences in Head-related Impulse Response between Front Direction and other Directions in the Median Plane |
|---|---|
| 0 | $d_{0l}(t)$, $d_{0r}(t)$ |
| 10 | $d_{10l}(t)$, $d_{10r}(t)$ |
| 20 | $d_{20l}(t)$, $d_{20r}(t)$ |
| 30 | $d_{30l}(t)$, $d_{30r}(t)$ |
| 40 | $d_{40l}(t)$, $d_{40r}(t)$ |
| 50 | $d_{50l}(t)$, $d_{50r}(t)$ |
| 60 | $d_{60l}(t)$, $d_{60r}(t)$ |
| 70 | $d_{70l}(t)$, $d_{70r}(t)$ |
| 80 | $d_{80l}(t)$, $d_{80r}(t)$ |
| 90 | $d_{90l}(t)$, $d_{90r}(t)$ |
| 100 | $d_{100l}(t)$, $d_{100r}(t)$ |
| 110 | $d_{110l}(t)$, $d_{110r}(t)$ |
| 120 | $d_{120l}(t)$, $d_{120r}(t)$ |
| 130 | $d_{130l}(t)$, $d_{130r}(t)$ |
| 140 | $d_{140l}(t)$, $d_{140r}(t)$ |
| 150 | $d_{150l}(t)$, $d_{150r}(t)$ |
| 160 | $d_{160l}(t)$, $d_{160r}(t)$ |
| 170 | $d_{170l}(t)$, $d_{170r}(t)$ |
| 180 | $d_{180l}(t)$, $d_{180r}(t)$ |
| 190 | $d_{190l}(t)$, $d_{190r}(t)$ |
| 200 | $d_{200l}(t)$, $d_{200r}(t)$ |
| 210 | $d_{210l}(t)$, $d_{210r}(t)$ |
| 220 | $d_{220l}(t)$, $d_{220r}(t)$ |
| 230 | $d_{230l}(t)$, $d_{230r}(t)$ |
| 240 | $d_{240l}(t)$, $d_{240r}(t)$ |
| 250 | $d_{250l}(t)$, $d_{250r}(t)$ |
| 260 | $d_{260l}(t)$, $d_{260r}(t)$ |
| 270 | $d_{270l}(t)$, $d_{270r}(t)$ |
| 280 | $d_{280l}(t)$, $d_{280r}(t)$ |
| 290 | $d_{290l}(t)$, $d_{290r}(t)$ |
| 300 | $d_{300l}(t)$, $d_{300r}(t)$ |
| 310 | $d_{310l}(t)$, $d_{310r}(t)$ |
| 320 | $d_{320l}(t)$, $d_{320r}(t)$ |
| 330 | $d_{330l}(t)$, $d_{330r}(t)$ |
| 340 | $d_{340l}(t)$, $d_{340r}(t)$ |
| 350 | $d_{350l}(t)$, $d_{350r}(t)$ |

FIG.6

| Time (t) | Front Direction Head-Related Impulse Response $h_l(t)$, $h_r(t)$ |
|---|---|
| 0 | $h_l(0)$, $h_r(0)$ |
| 1 | $h_l(1)$, $h_r(1)$ |
| 2 | $h_l(2)$, $h_r(2)$ |
| 3 | $h_l(3)$, $h_r(3)$ |
| 4 | $h_l(4)$, $h_r(4)$ |
| 5 | $h_l(5)$, $h_r(5)$ |
| 6 | $h_l(6)$, $h_r(6)$ |
| 7 | $h_l(7)$, $h_r(7)$ |
| ▪ | |
| ▪ | |
| ▪ | |
| n | $h_l(n)$, $h_r(n)$ |

FIG.7
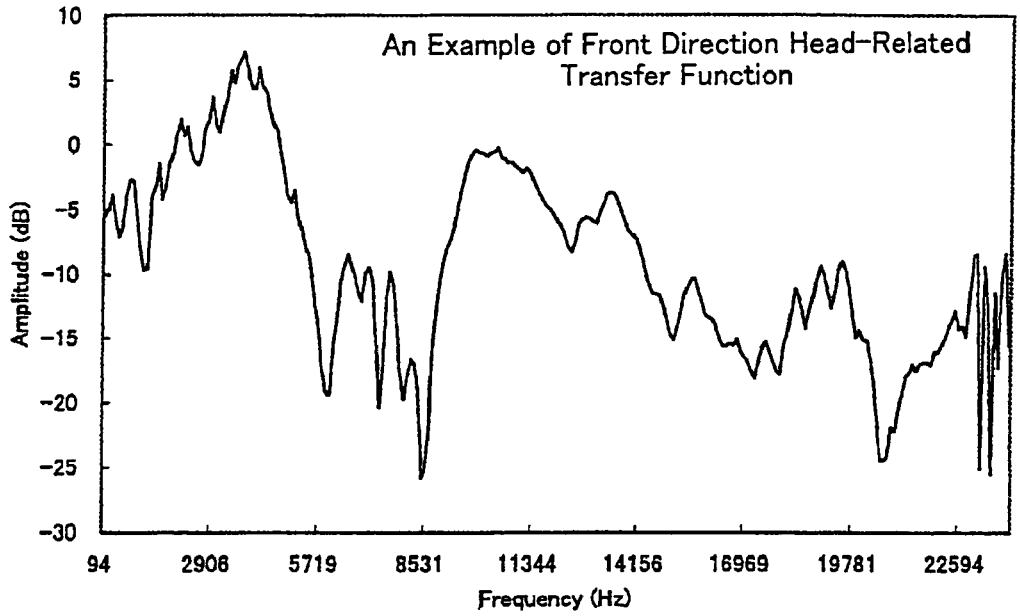
(a)
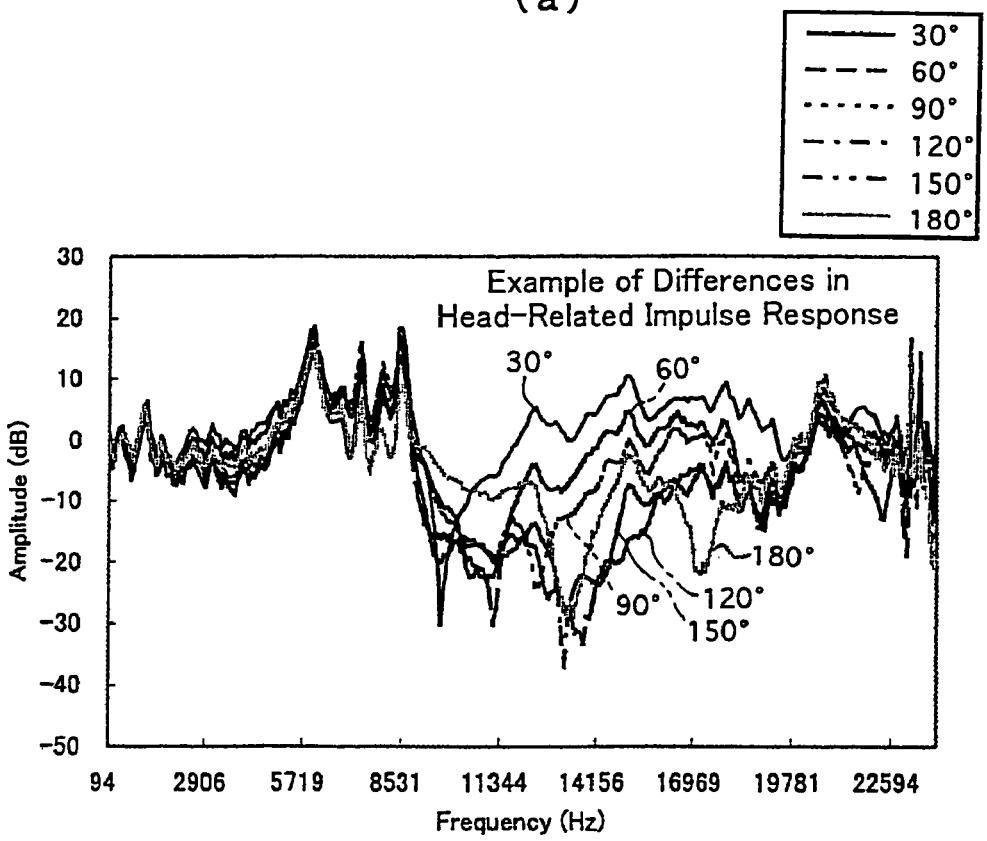
(b)

FIG.9
(a)
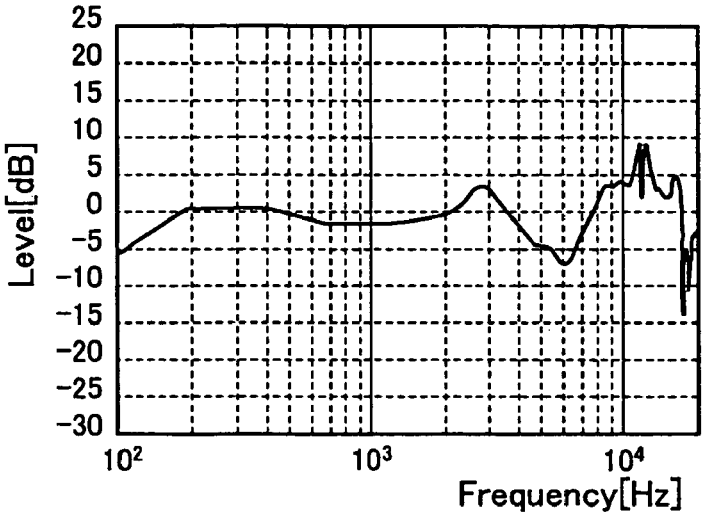
(b)
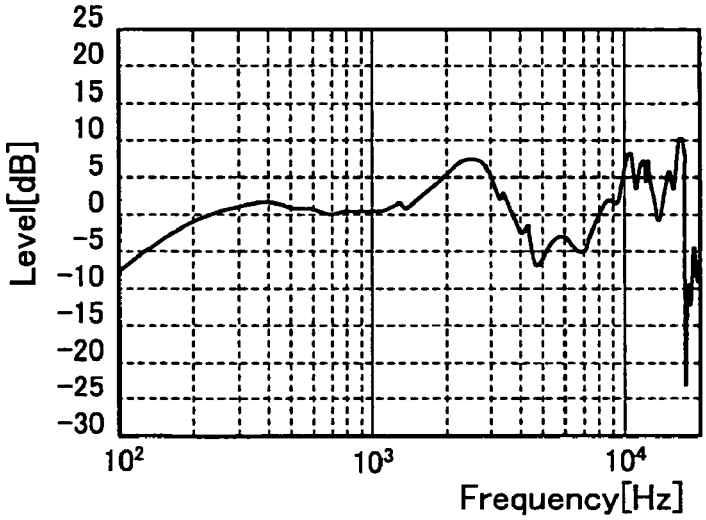
(c)
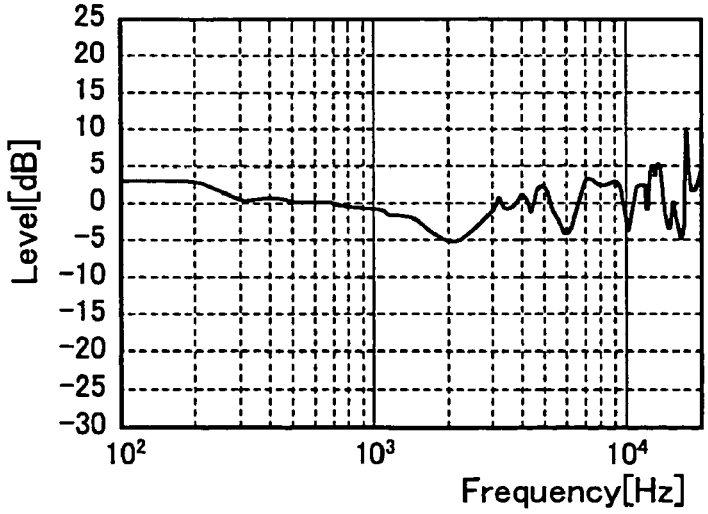

SOUND IMAGE LOCALIZER

FIELD OF THE INVENTION

The present invention relates to a sound image localizing apparatus for generating a sound image localized in an arbitrarily set three-dimensional direction.

BACKGROUND OF THE INVENTION

Up until now, there have been provided a wide variety of sound image localizing apparatuses, one typical example of which is disclosed in, for example, the Japanese Patent Publication No. 2741817 and shown in FIG. 19.

In the conventional sound image localizing apparatus, an A/D conversion unit 2110 is connected with a test sound source. A convolution operation unit 2120 includes a left-ear convolution operation unit (1) 2120L, and a right-ear convolution operation unit (r) 2120R. A two-channel D/A conversion unit 2130 is designed to convert signals respectively inputted from the left-ear convolution operation unit (1) 2120L and the right-ear convolution operation unit (r) 2120R, from digital format into analog format, and to respectively output signals thus converted to left-ear and right-ear portions of a headphone such as, for example, an ear-plug type headphone, an inner-earphone, or the like, not shown. A space impulse response storage unit 2150 and a headphone inverse impulse response storage unit 2160 serve as database for storing a predetermined set of filter coefficients (convolution data). The convolution operation unit 2120 is designed to selectively download appropriate filter coefficients from the convolution data stored in the space impulse response storage unit 2150 and the headphone inverse impulse response storage unit 2160. Data "$S_{oil}(t)$" stored in the space impulse response storage unit 2150 indicates a left-ear i-th response in a median plane, data "$S_{oir}(t)$" indicates a right-ear i-th response in the median plane, data "$S_{dil}(t)$" indicates a left-ear i-th response in direction d, and data "$H^{-1}_{i}(t)$" indicates a headphone inverse impulse response. The convolution operation unit 2120 can be selectively connected with and input signals from output sections of the AID conversion unit 2110 and a sound source storage unit 2140 by means of a switch 2170.

The conventional sound image localizing apparatus thus constructed can generate sound image signals, for example, two-channel sound signals, collectively constitute a sound image in a manner of convoluting the sound source signal with space impulse responses and headphone inverse impulse responses collectively corresponding to a direction to which the sound image is to be localized.

The conventional sound image localizing apparatus, however, encounters a drawback that the conventional sound image localizing apparatus is designed to store a set of typical filter coefficients. This leads to the fact that the space impulse responses, i.e., head-related impulse responses are required to be measured and generated for all the directions, to which the sound image is to be located, thereby requiring an enormous amount of laborious works and time for the measurement. Furthermore, the conventional sound image localizing apparatus requires a large amount of storage areas for storing the set of filter coefficients.

The conventional sound image localizing apparatus is operative to convolute the sound source signal with the headphone inverse impulse responses to suppress inverse characteristics inherent in the headphone. The conventional sound image localizing apparatus, however, cannot correct the variation of an ear canal transfer function resulted from a headphone or an earphone mounted on the listener's outer ear, thereby leading to the fact that the conventional sound image localizing apparatus cannot accurately localize a sound image when a headphone or an earphone is mounted on the listener's outer ear.

In view of the foregoing problems, it is an object of the present invention to provide a sound image localizing apparatus, which can accurately localize a sound image with a small amount of storage areas, as well as eliminate a need of measuring and generating head-related impulse responses for all the directions, to which the sound image is to be located.

SUMMARY OF THE INVENTION

In accordance with one aspect of the present invention, there is provided a sound image localizing apparatus comprising a head-related transfer function processing unit for generating sound image signals collectively constituting a sound image in response to a sound source signal, the head-related transfer function processing unit including: a sound image direction setting unit for setting a direction to which the sound image is to be localized; an angle conversion unit for converting the direction into a lateral angle and a rising angle; a lateral angle control information storage unit for storing lateral angle control information, in accordance with which the sound image is generated with respect to the lateral angle; a front direction head-related impulse response storage unit for storing a front direction head-related impulse response; a rising angle difference information storage unit for storing rising angle difference information, in accordance with which the sound image is generated with respect to the rising angle; and a convolution operation unit for convoluting a sound source signal with the lateral angle control information, the front direction head-related impulse response, and the rising angle difference information. This construction makes it possible for the sound image localizing apparatus to convert the direction, to which the sound image is to be localized, into a lateral angle and a rising angle, and generate sound image signals constituting the sound image localized in the direction determined by the lateral angle and the rising angle thus converted.

Preferably, the aforesaid lateral angle control information storage unit should store at least one of interaural time difference information and interaural sound level difference information as the lateral angle control information. This constitution makes it possible for the sound image localizing apparatus to control the sound signals in accordance with the interaural time difference information and interaural sound level difference information corresponding to the lateral angle.

Preferably, the aforesaid rising angle difference information storage unit should store difference information in head-related impulse response between front direction and other directions in a median plane with respect to rising angles. This constitution makes it possible for the sound image-localizing apparatus to control the sound signals in accordance with the difference information between the front direction head-related impulse response in the median plane and front direction head-related impulse responses at the rising angle.

Preferably, the aforesaid sound image localizing apparatus should comprise: an ear canal transfer function correction processing unit for convoluting a signal outputted from the convolution operation unit with ear canal transfer function correction data to correct an ear canal transfer function in consideration of variations resulted from a headphone or an earphone mounted on an outer ear. This constitution makes it possible for the sound image localizing apparatus to correct the ear canal transfer function in consideration of variations resulted from a headphone or an earphone mounted on an outer ear.

In accordance with another aspect of the present invention, there is provided a sound image localizing apparatus comprising: a head-related transfer function processing unit for generating sound image signals collectively constituting a sound image in response to a sound source signal by means of a standard head-related transfer function; an ear canal transfer function correction processing unit for correcting a signal outputted from the head-related transfer function processing unit on the basis of ear canal transfer function correction information to correct a standard ear canal transfer function in consideration of variations resulted from a headphone or an earphone mounted on an outer ear to generate corrected sound image signals collectively constituting the sound image, the corrected sound image signals being to be outputted to the headphone or the earphone. The constitution makes it possible for the sound image localizing apparatus to generate sound image signals collectively constituting a sound image in response to a sound source signal by means of a standard head-related transfer function and a standard ear canal transfer function, and to output the sound image signals thus generated to the headphone or the earphone.

The aforesaid sound image localizing apparatus may further comprise: a head-related transfer function adjusting processing unit for adjusting a signal outputted from the head-related transfer function processing unit in a manner of altering a head-related transfer function, in accordance with which the signal is to be processed, to a target head-related transfer function. This constitution makes it possible for the sound image localizing apparatus to alter a head-related transfer function, in accordance with which the signal is to be processed, to a target head-related transfer function, which is appropriate for the listener.

The aforesaid sound image localizing apparatus further comprises an ear canal transfer function correction adjusting processing unit for adjusting a signal processed by the ear canal transfer function correction processing unit in a manner of altering an ear canal transfer function, in accordance with which the signal is to be processed, to a target ear canal transfer function. This constitution makes it possible for the sound image localizing apparatus to alter the ear canal transfer function, in accordance with which the signal is to be processed, to the target ear canal transfer function, which is appropriate for the listener.

In accordance with a still further aspect of the present invention, there is provided a conference apparatus comprising: a sound image localizing processing unit for generating sound image signals collectively constituting a sound image, the sound image localizing processing unit including a head-related transfer function processing unit for generating sound image signals collectively constituting a sound image by means of a head-related transfer function, and a correction unit for correcting a signal in a manner of correcting an ear canal transfer function. The aforesaid correction unit includes an ear canal transfer function correction processing unit for correcting a signal to generate corrected sound image signals collectively constituting a sound image, the corrected sound image signals being to be outputted to the headphone or the earphone, whereby the sound image localizing processing unit is operative to generate sound image signals collectively constituting a sound image, and to transmit the sound image signals, and the correction unit is operative to correct a received signal. This constitution makes it possible for the conference apparatus to generate sound image signals collectively constituting a sound image, and to transmit the sound image signals thus generated. Furthermore, this constitution enables to perform an ear canal transfer function correction processing on a received signal in accordance with the characteristics of a headphone or an earphone mounted on an outer ear, and to accurately localize a sound image.

In accordance with a yet further aspect of the present invention, there is provided a conference apparatus comprising: a sound image localizing processing unit for generating sound image signals collectively constituting a sound image, the sound image localizing processing unit including a head-related transfer function processing unit for generating sound image signals collectively constituting a sound image by means of a standard head-related transfer function, and an ear canal transfer function correction processing unit for correcting a signal outputted from the head-related transfer function processing unit on the basis of standard ear canal transfer function correction information in consideration of variations resulted from a headphone or an earphone mounted on an outer ear to generate corrected sound image signals collectively constituting the sound image, the corrected sound image signals being to be outputted to the headphone or the earphone; and a correction unit for correcting a signal in a manner of correcting a difference between a standard characteristic and a target characteristic, the correction unit comprising an adjusting processing unit including at least one of a head-related transfer function adjusting processing unit and an ear canal transfer function correction adjusting processing unit, the head-related transfer function adjusting processing unit operative to correct a signal processed by a head-related transfer function processing unit in a manner of adjusting a difference between a target head-related transfer function and the standard head-related transfer function; and the ear canal transfer function correction adjusting processing unit operative to correct a signal processed by the ear canal transfer function correction processing unit in a manner of adjusting a difference between target ear canal transfer function correction information and standard ear canal transfer function correction information whereby the sound image localizing processing unit is operative to process a signal to be transmitted, and the correction unit is operative to process a received signal. The constitution makes it possible for the conference apparatus to perform a standard sound image localizing processing on a sound signal to be transmitted. Furthermore, the constitution enables to perform an ear canal transfer function correction processing on a received signal in accordance with the characteristics of a headphone or an earphone mounted on an outer ear, and to accurately localize a sound image.

In accordance with another aspect of the present invention, there is provided a portable phone comprising: a sound image localizing processing unit for generating sound image signals collectively constituting a sound image, the sound image localizing processing unit including a head-related transfer function processing unit for generating sound image signals collectively constituting a sound image by means of a head-related transfer function; a correction unit for correcting a signal in a manner of correcting an ear canal transfer function, the correction unit including an ear canal transfer function correction processing unit for generating corrected sound image signals collectively constituting a sound image on the basis of ear canal transfer function correction information in consideration of variations resulted from a headphone or an earphone mounted on an outer ear, the corrected sound image signals being to be outputted to the headphone or the earphone, whereby the sound image localizing processing unit is operative to process a sound signal to be transmitted, and the correction unit is operative to process a received sound signal. The constitution makes it possible for the portable phone to perform a sound image localizing processing on a sound signal to be transmitted. Furthermore, the constitution enables to perform an ear canal transfer function correction processing on a received signal in accordance with the characteristics of a headphone or an earphone mounted on an outer ear, and to accurately localize a sound image.

In accordance with another aspect of the present invention, there is provided a portable phone comprising: a sound image localizing processing unit for generating sound image signals collectively constituting a sound image, the sound image localizing processing unit including a head-related transfer function processing unit for generating sound image signals collectively constituting a sound image by means of a standard head-related transfer function, and an ear canal transfer function correction processing unit for correcting a signal outputted from the head-related transfer function processing unit on the basis of standard ear canal transfer function correction information in consideration of variations resulted from a headphone or an earphone mounted on an outer ear to generate corrected sound image signals collectively constituting the sound image, the corrected sound image signals being outputted to the headphone or the earphone; and a correction unit for correcting a signal in a manner of correcting a difference between a standard characteristic and a target characteristic, the correction unit comprising an adjusting processing unit including at least one of a head-related transfer function adjusting processing unit and an ear canal transfer function correction adjusting processing unit, the head-related transfer function adjusting processing unit operative to correct a signal processed by a head-related transfer function processing unit in a manner of adjusting a difference between a target head-related transfer function and the standard head-related transfer function; and the ear canal transfer function correction adjusting processing unit operative to correct a signal processed by the ear canal transfer function correction processing unit in a manner of adjusting a difference between target ear canal transfer function correction information and standard ear canal transfer function correction information, whereby the sound image localizing processing unit is operative to process a signal to be transmitted, and the correction unit is operative to process a received signal. The constitution makes it possible for the portable phone to perform a standard sound image localizing processing on a sound signal to be transmitted. Furthermore, the constitution enables to perform an ear canal transfer function correction processing on a received sound signal in accordance with the characteristics of a headphone or an earphone mounted on an outer ear, and to accurately localize a sound image.

In accordance with another aspect of the present invention, there is provided an audio player comprising: a sound image localizing processing unit for generating sound image signals collectively constituting a sound image, the sound image localizing processing unit including a head-related transfer function processing unit for generating sound image signals collectively constituting a sound image by means of a head-related transfer function; a correction unit for correcting a signal in a manner of correcting an ear canal transfer function, the correction unit including an ear canal transfer function correction processing unit for generating corrected sound image signals collectively constituting the sound image on the basis of ear canal transfer function correction information in consideration of variations resulted from a headphone or an earphone mounted on an outer ear, the corrected sound image signals being to be outputted to the headphone or the earphone; and a signal detection unit for detecting a sound signal and a record information signal recorded on a record medium, whereby the sound image localizing processing unit is operative to judge whether to perform a sound image localizing processing on a sound signal readout from the record medium in response to the record information signal detected by the signal detection unit while the correction unit is processing. The constitution makes it possible for the audio player to perform no sound image localizing processing on a sound signal readout from the record medium when a sound image localizing processing has been performed on the sound signal recorded on the record medium and to perform a sound image localizing processing on a sound signal readout from the record medium when the sound image localizing processing has not been performed on the sound signal recorded on the record medium. Furthermore, the constitution enables to perform a correction processing on a received signal in accordance with the characteristics of a headphone or an earphone mounted on an outer ear, thereby making it possible for a listener to listen to sounds constituting a sound image accurately localized.

In accordance with another aspect of the present invention, there is provided an audio player comprising: a sound image localizing processing unit for generating sound image signals collectively constituting a sound image, the sound image localizing processing unit including a head-related transfer function processing unit for generating sound image signals collectively constituting a sound image by means of a head-related transfer function, and an ear canal transfer function correction processing unit for correcting a signal outputted from the head-related transfer function processing unit on the basis of standard ear canal transfer function correction information in consideration of variations resulted from a headphone or an earphone mounted on an outer ear to generate corrected sound image signals collectively constituting the sound image, the corrected sound image signals being to be outputted to the headphone or the earphone; a correction unit for correcting a signal in a manner of correcting a difference between a standard characteristic and a target characteristic, the correction unit comprising an adjusting processing unit including at least one of a head-related transfer function adjusting processing unit and an ear canal transfer function correction adjusting processing unit, the head-related transfer function adjusting processing unit operative to correct a signal processed by a head-related transfer function processing unit in a manner of adjusting a difference between a target head-related transfer function and the standard head-related transfer function; and the ear canal transfer function correction adjusting processing unit operative to correct a signal processed by the ear canal transfer function correction processing unit in a manner of adjusting a difference between target ear canal transfer function correction information and standard ear canal transfer function correction information; and a signal detection unit for detecting a sound signal and a record information signal recorded on a record medium, whereby the sound image localizing processing unit is operative to judge whether to perform a sound image localizing processing on a sound signal readout from the record medium in response to the record information signal detected by the signal detection unit while the correction unit is processing. The constitution makes it possible for the audio player to perform no sound image localizing processing on a sound signal readout from the record medium when a sound image localizing processing has been performed on the sound signal recorded on the record medium and to perform a sound image localizing processing on a sound signal readout from the record medium when the sound image localizing processing has not been performed on the sound signal recorded on the record medium. Furthermore, the constitution enables to perform a correction processing on a received signal in accordance with the characteristics of a headphone or an earphone mounted on an outer ear, thereby making it possible for a listener to listen to sounds constituting a sound image accurately localized.

In accordance with another aspect of the present invention, there is provided an audio recorder comprising: a sound image localizing processing unit for generating sound image signals collectively constituting a sound image, the sound image localizing processing unit including a head-related transfer function processing unit for generating sound image signals collectively constituting a sound image by means of a head-related transfer function; and a record unit for recording a sound signal on a record medium, whereby the sound image localizing processing unit is operative to perform a sound image localizing processing on a received sound signal, and the record unit is operative to record on a record medium a sound signal outputted from the sound image localizing processing unit. The constitution makes it possible for the audio recorder to generate sound signals collectively constituting a sound image, and to record the sound signals on a record medium, thereby enabling an audio player to reproduce sounds, from the sound signals thus recorded on the record medium, optimally audible to a listener without performing additional processing such as a sound image localizing processing, on the sound signals.

In accordance with another aspect of the present invention, there is provided an audio recorder comprising: a sound image localizing processing unit for generating sound image signals collectively constituting a sound image, the sound image localizing processing unit including a head-related transfer function processing unit for generating sound image signals collectively constituting a sound image by means of a head-related transfer function, and an ear canal transfer function correction processing unit for correcting a signal outputted from the head-related transfer function processing unit on the basis of standard ear canal transfer function correction information in consideration of variations resulted from a headphone or an earphone mounted on an outer ear to generate corrected sound image signals collectively constituting the sound image, the corrected sound image signals being to be outputted to the headphone or the earphone; and a record unit for recording a sound signal on a record medium, whereby the sound image localizing processing unit is operative to perform a sound image localizing processing on a received sound signal, and the record unit is operative to record on a record medium a sound signal outputted from the sound image localizing processing unit. The constitution makes it possible for the audio recorder to generate sound signals collectively constituting a sound image, and to record the sound signals on a record medium, thereby enabling an audio player to reproduce sounds, from the sound signals thus recorded on the record medium, optimally audible to a listener without performing additional processing such as a sound image localizing processing, on the sound signals.

In accordance with another aspect of the present invention, there is provided a delivery apparatus comprising: a sound image localizing processing unit for generating sound image signals collectively constituting a sound image, the sound image localizing processing unit including a head-related transfer function processing unit for generating sound image signals collectively constituting a sound image by means of a head-related transfer function, whereby the sound image localizing processing unit is operative to perform a sound image localizing processing on a sound signal, and the delivery apparatus is operative to transmit a sound signal processed and outputted by the sound image localizing processing unit, in a predetermined signal form in combination with localizing control information outputted from the sound image localizing processing unit as processing information. The constitution makes it possible for the delivery apparatus to transmit a sound signal, on which a sound image localizing processing has been performed, in a predetermined signal form in combination with localizing control information, and makes it possible for a receiving machine to reproduce sounds optimally audible to a listener without performing additional processing such as, for example, a sound image localizing processing, on the sound signals.

In accordance with another aspect of the present invention, there is provided a delivery apparatus comprising: a sound image localizing processing unit for generating sound image signals collectively constituting a sound image, the sound image localizing processing unit including a head-related transfer function processing unit for generating sound image signals collectively constituting a sound image by means of a head-related transfer function, and an ear canal transfer function correction processing unit for correcting a signal outputted from the head-related transfer function processing unit on the basis of standard ear canal transfer function correction information in consideration of variations resulted from a headphone or an earphone mounted on an outer ear to generate corrected sound image signals collectively constituting the sound image, the corrected sound image signals being to be outputted to the headphone or the earphone, whereby the sound image localizing processing unit is operative to perform a sound image localizing processing on a sound signal, and the delivery apparatus is operative to transmit a sound signal processed and outputted by the sound image localizing processing unit, in a predetermined signal form in combination with localizing control information outputted from the sound image localizing processing unit as processing information. The constitution makes it possible for the delivery apparatus to transmit a sound signal, on which a sound image localizing processing has been performed, in a predetermined signal form in combination with localizing control information, and makes it possible for a receiving machine to reproduce sounds optimally audible to a listener without performing additional processing such as, for example, a sound image localizing processing, on the sound signals.

In accordance with another aspect of the present invention, there is provided a receiving apparatus comprising: a receiving unit for receiving a sound signal and localizing information related to the sound signal, and a correction unit for correcting a signal in a manner of correcting an ear canal transfer function, the correction unit including an ear canal transfer function correction processing unit for correcting a signal on the basis of ear canal transfer function correction information in consideration of variations resulted from a headphone or an earphone mounted on an outer ear to generate corrected sound image signals collectively constituting the sound image, the corrected sound image signals being to be outputted to the headphone or the earphone, whereby the correction unit is operative to correct the ear canal transfer function in accordance with the localizing information. The constitution makes it possible for the receiving apparatus to perform a correction processing on a received sound signal with reference to the received localizing information and the characteristics of a headphone or an earphone mounted on the listener's outer ear, thereby enabling the listener to listen to sounds constituting a sound image accurately localized.

In accordance with another aspect of the present invention, there is provided a receiving apparatus comprising: a receiving unit for receiving a sound signal and localizing information related to the sound signal, a correction unit for correcting a signal in a manner of correcting a difference between a standard characteristic and a target characteristic, the correction unit comprising an adjusting processing unit including at least one of a head-related transfer function adjusting processing unit and an ear canal transfer function correction adjusting processing unit, the head-related transfer function adjusting processing unit operative to adjust a difference between a target head-related transfer function and a head-related transfer function of the sound signal, and the ear canal transfer function correction adjusting processing unit operative to adjust a difference between target ear canal transfer function correction information and standard ear canal transfer function correction information of the sound signal, whereby the correction unit is operative to correct the difference between a standard characteristic and a target characteristic in accordance with the localizing information. The constitution makes it possible for the receiving apparatus to perform a correction processing on a received sound signal with reference to the received localizing information and the characteristics of a headphone or an earphone mounted on the listener's outer ear, thereby enabling the listener to listen to sounds constituting a sound image accurately localized.

In accordance with another aspect of the present invention, there is provided a game machine comprising: a sound image localizing processing unit for generating sound image signals collectively constituting a sound image, the sound image localizing processing unit including a head-related transfer function processing unit for generating sound image signals collectively constituting a sound image by means of a head-related transfer function, a correction unit for correcting a signal in a manner of correcting an ear canal transfer function, the correction unit including an ear canal transfer function correction processing unit for correcting a signal outputted from the head-related transfer function processing unit on the basis of ear canal transfer function correction information in consideration of variations resulted from a headphone or an earphone mounted on an outer ear to generate corrected sound image signals collectively constituting the sound image, the corrected sound image signals being to be outputted to the headphone or the earphone; a signal detection unit for detecting a sound signal and a record information signal recorded on a record medium; and a controller, whereby the sound image localizing processing unit is operative to perform a sound image localizing processing on a sound signal readout from the record medium in response to the record information signal detected by the signal detection unit, and operation of the controller while the correction unit is processing. The constitution makes it possible for the game machine to generate sound image signals collectively constituting a sound image in response to the localizing information and to signal recorded on the record medium and the user's operation of the controller, and to perform a correction processing on the sound image signals thus generated with reference to the characteristics of the user and the stereo headphone or the earphone, thereby enabling a listener to enjoy a virtual sound space regardless of where the listener is placed.

In accordance with another aspect of the present invention, there is provided a game machine comprising: a sound image localizing processing unit for generating sound image signals collectively constituting a sound image, the sound image localizing processing unit including a head-related transfer function processing unit for generating sound image signals collectively constituting a sound image by means of a standard head-related transfer function, and an ear canal transfer function correction processing unit for correcting a signal outputted from the head-related transfer function processing unit on the basis of standard ear canal transfer function correction information in consideration of variations resulted from a headphone or an earphone mounted on an outer ear to generate corrected sound image signals collectively constituting the sound image, the corrected sound image signals being to be outputted to the headphone or the earphone; a correction unit for correcting a signal in a manner of correcting a difference between a standard characteristic and a target characteristic, the correction unit comprising an adjusting processing unit including at least one of a head-related transfer function adjusting processing unit and an ear canal transfer function correction adjusting processing unit, and the head-related transfer function adjusting processing unit operative to correct a signal processed by a head-related transfer function processing unit in a manner of adjusting a difference between a target head-related transfer function and the standard head-related transfer function, a signal detection unit for detecting a sound signal and a record information signal recorded on a record medium, and a controller, whereby the sound image localizing processing unit is operative to perform a sound image localizing processing on a sound signal readout from the record medium in response to the record information signal detected by the signal detection unit, and operation of the controller while the correction unit is processing. The constitution makes it possible for the game machine to generate sound image signals collectively constituting a sound image in response to the localizing information and to signal recorded on the record medium and the user's operation of the controller, and to perform a correction processing on the sound image signals thus generated with reference to the characteristics of the user and the stereo headphone or the earphone, thereby enabling a listener to enjoy a virtual sound space regardless of where the listener is placed.

In accordance with another aspect of the present invention, there is provided a sound signal reproduction apparatus comprising: a correction unit for correcting a signal in a manner of correcting an ear canal transfer function, the correction unit including an ear canal transfer function correction processing unit for correcting a signal on the basis of ear canal transfer function correction information in consideration of variations resulted from a headphone or an earphone mounted on an outer ear to generate corrected sound image signals collectively constituting the sound image, the corrected sound image signals being to be outputted to the headphone or the earphone; and a reproduction unit for reproducing a sound in response to the sound signal, whereby the correction unit is operative to perform a correction processing in consideration of characteristics of the reproduction unit, and the correction unit and the reproduction unit collectively forming one section. The constitution makes it possible for the sound signal reproduction apparatus to perform a correction processing on a sound signal, on which a sound image localizing processing has been performed, in consideration of the variation resulted from the use of a headphone or an earphone attached to the reproduction apparatus, thereby enabling to accurately reproduce sounds collectively constituting the sound image.

In accordance with another aspect of the present invention, there is provided a sound signal reproduction apparatus comprising: a correction unit for correcting a signal in a manner of correcting a difference between a standard characteristic and a target characteristic, the correction unit comprising an adjusting processing unit including at least one of a head-related transfer function adjusting processing unit and an ear canal transfer function correction adjusting processing unit, and the head-related transfer function adjusting processing unit operative to correct a signal processed by a head-related transfer function processing unit in a manner of adjusting a difference between a target head-related transfer function and the standard head-related transfer function, a signal detection unit for detecting a sound signal and a record information signal recorded on a record medium, and a controller, whereby the sound image localizing processing unit is operative to perform a sound image localizing processing on a sound signal readout from the record medium in response to the record information signal detected by the signal detection unit, and operation of the controller while the correction unit is processing. The constitution makes it possible for the sound signal reproduction apparatus to perform a correction processing on a sound signal, on which a sound image localizing processing has been performed, in consideration of the variation resulted from the use of a headphone or an earphone attached to the reproduction apparatus, thereby enabling to accurately reproduce sounds collectively constituting the sound image.

BRIEF DESCRIPTION OF THE DRAWINGS

The features and advantages of the sound image localizing apparatus according to the present invention will more clearly be understood from the following description taken in conjunction with the accompanying drawings in which:

FIG. 2 is a block diagram showing a first construction of a lateral angle control information storage unit constituting the first embodiment of the sound image localizing apparatus according to the present invention;

FIG. 3 is a block diagram showing a second construction of the lateral angle control information storage unit constituting the first embodiment of the sound image localizing apparatus according to the present invention;

FIG. 4 is a block diagram showing a third construction of the lateral angle control information storage unit constituting the first embodiment of the sound image localizing apparatus according to the present invention;

FIG. 5 is a block diagram showing a construction of a rising angle difference information storage unit constituting the first embodiment of the sound image localizing apparatus according to the present invention;

FIG. 6 is a block diagram showing a construction of a front direction head-related impulse response storage unit constituting the first embodiment of the sound image localizing apparatus according to the present invention;

FIG. 7 is a set of graphs showing examples of front direction head-related impulse responses and differences of front direction head-related impulse responses with respect to rising angles.

FIG. 9 is a set of graphs explaining ear canal transfer function correction adjusting data stored in the second preferred embodiment of the sound image localizing apparatus according to the present invention;

DESCRIPTION OF THE PREFERRED EMBODIMENTS

Description of the preferred embodiment of the present invention will be made hereinlater with reference to the drawings. Referring to FIGS. 1 to 7 of the drawings, there is shown a first preferred embodiment of the sound image localizing apparatus according to the present invention.

Figure 1:
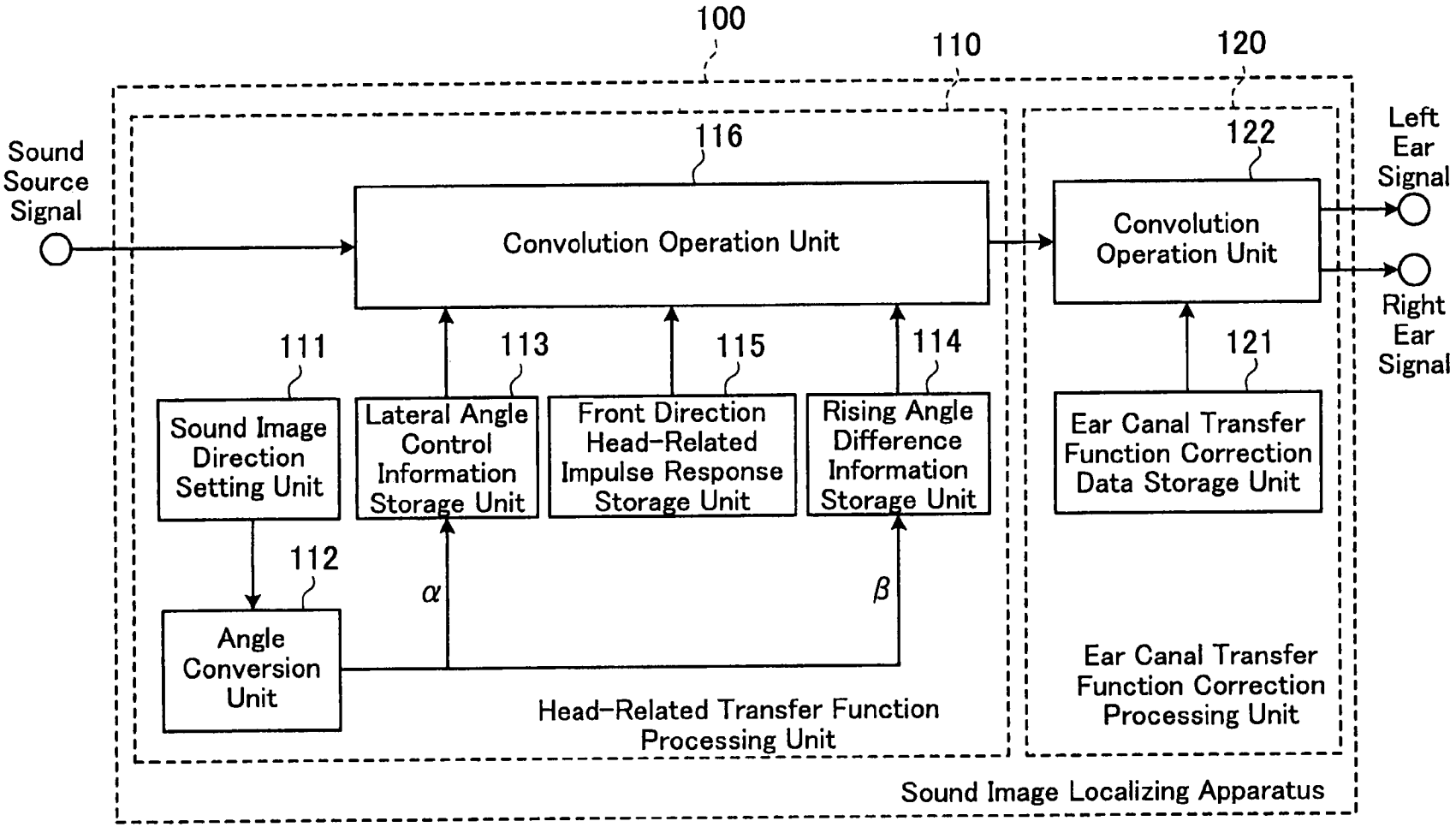
FIG. 1 is a block diagram showing a first preferred embodiment of the sound image localizing apparatus according to the present invention.

The present embodiment of the sound image localizing apparatus 100 according to the present invention is shown in FIG. 1 as comprising a head-related transfer function processing unit 110 for processing a signal in accordance with a head-related transfer function, i.e., performing a head-related transfer function processing on the signal, and an ear canal transfer function correction processing unit 120 for processing a signal in a manner of correcting an ear canal transfer function, which will be described later.

The head-related transfer function processing unit 110 is designed to generate sound image signals, for example, two-channel sound signals, collectively constituting a sound image. The head-related transfer function processing unit 110 comprises a sound image direction setting unit 111 for setting a direction to which the sound image constituted by the sound image signals generated in response to a sound source signal is to be localized, an angle conversion unit 112 for converting the direction into a lateral angle $\alpha$, and a rising angle $\beta$, a lateral angle control information storage unit 113 for storing lateral angle control information, in accordance with which the sound image is controlled with respect to the lateral angle $\alpha$, a rising angle difference information storage unit 114 for storing rising angle difference information, in accordance with which the sound image is controlled with respect to the rising angle $\beta$, a front direction head-related impulse response storage unit 115 for storing a front direction head-related impulse response, and a convolution operation unit 116 for convoluting the sound signal with the lateral angle control information, the front direction head-related impulse response, and the rising angle difference information.

The ear canal transfer function correction processing unit 120 comprises an ear canal transfer function correction data storage unit 121 for storing ear canal transfer function correction data, and convolution operation unit 122 for convoluting a sound signal with ear canal transfer function correction information, and generating a signal to be outputted to a headphone such as, for example, an ear-plug type headphone, an inner-earphone, or the like.

The lateral angle control information storage unit 113 is designed to store interaural time difference information, or interaural sound level difference information, or both the interaural time difference information and the interaural sound level difference information as the lateral angle control information.

An example of interaural time difference information stored in the lateral angle control information storage unit 113 as the lateral angle control information is shown in FIG. 2. The interaural time difference information shown in FIG. 2 indicates standard values, which are interaural time differences of a standard adult with respect to lateral angles. A listener is, for example, already known; the interaural time differences of the known listener may be measured with respect to lateral angles, and the lateral angle control information storage unit 113 may store the measured values.

An example of interaural sound level difference information stored in the lateral angle control information storage unit 113 as the lateral angle control information is shown in FIG. 3. The interaural sound level difference information shown in FIG. 3 indicates standard values, which are interaural sound level differences of a standard adult with respect to lateral angles. A listener is, for example, already known; the interaural sound level differences of the known listener may be measured with respect to lateral angles, and the lateral angle control information storage unit 113 may store the measured values.

An example of interaural time difference information and interaural sound level difference information stored in the lateral angle control information storage unit 113 as the lateral angle control information is shown in FIG. 4. The interaural time difference information and interaural sound level difference information shown in FIG. 4 indicates standard values, which are interaural time differences and interaural sound level differences of a standard adult with respect to lateral angles. A listener is, for example, already known; the interaural time differences and interaural sound level differences of the known listener may be measured with respect to lateral angles, and the lateral angle control information storage unit 113 may store the measured values.

The rising angle difference information storage unit 114 is adapted to store differences in head-related impulse response between a front direction and other directions in a median plane with respect to rising angles, simply referred to as, "rising angle difference information". The rising angle difference information does not differ so much from individual to individual. Accordingly, the rising angle difference information storage unit 114 may store rising angle difference information of a standard adult. Examples of the rising angle difference information are shown in FIG. 5.

The front direction head-related impulse response storage unit 115 is adapted to store listener's front direction head-related impulse responses, which have been measured at a listener's position in a front direction. Examples of the front direction head-related impulse responses are shown in FIG. 6.

Examples of measured front direction head-related impulse responses and rising angle difference information are shown in FIG. 7 wherein an example of front direction head-related transfer function is shown in FIG. 7(*a*), and an example of differences of front direction head-related transfer function with respect to rising angles is shown in FIG. 7(*b*).

The operation of the sound image localizing apparatus 100 will be described hereinlater. The sound image direction setting unit 111 of the head-related transfer function processing unit 110 is operated to set a three-dimensional direction to which the sound image is to be localized in accordance with a listener's instruction. The three-dimensional direction may be specified in a coordinate system of any kind. The angle conversion unit 112 is operated to convert the direction into a lateral angle $\alpha$, and a rising angle $\beta$, each of which serves as a cue for the listener to perceive the direction. The direction is specified in, for example, a polar coordinate system (with an azimuthal angle $\phi$ and an elevation angle $\theta$), the direction is converted into a lateral angle $\alpha$, and a rising angle $\beta$ in accordance with equation (1) as follows.

$$\alpha=\arccos(\sin\phi\cos\theta)$$

$$\beta=\arcsin(\sin\theta/(\sin^2\theta+\cos^2\phi\cos^2\theta)^{1/2}) \quad (1)$$

The sound image localizing apparatus 100 is then operated to obtain interaural time difference information or interaural sound level difference information, or both the interaural time difference information and the interaural sound level difference information from the lateral angle control information storage unit 113 in response to the lateral angle $\alpha$, and to store the interaural time difference information or interaural sound level difference information, or both the interaural time difference information and the interaural sound level difference information thus obtained in the convolution operation unit 116. The sound image localizing apparatus 100 is operated to obtain a listener's front direction head-related impulse response from the front direction head-related impulse response storage unit 115, and store the front direction head-related impulse response thus obtained in the convolution operation unit 116.

The sound image localizing apparatus 100 is operated to obtain rising angle difference information, i.e., difference information of the front direction head-related impulse responses with respect to a rising angle from the rising angle difference information storage unit 114 in response to the rising angle $\beta$, and store the rising angle difference information with respect to the rising angle $\beta$ thus obtained in the convolution operation unit 116.

The convolution operation unit 116 is operated to convolute the sound source signal with the lateral angle control information, the front direction head-related impulse response, and the rising angle difference information, and output a signal.

The convolution operation unit 122 of the ear canal transfer function correction processing unit 120 is operated to convolute the signal outputted from the convolution operation unit 116 with the ear canal transfer function correction data stored in the ear canal transfer function correction data storage unit 121, to correct an ear canal transfer function, in accordance with which a signal is to be processed, which will be described later, in consideration of variations resulted from a headphone or an earphone mounted on an outer ear, to generate right-ear and left-ear signals collectively constituting the sound image, and to output the signals therethrough.

A principle of calculating ear canal transfer function correction data stored in the ear canal transfer function correction data storage unit 121 in the case of, for example, an earphone will be described hereinlater. In this case, it is assumed that the ear canal transfer function correction data is calculated with respect to frequency areas instead of time areas for simplicity and better understanding.

Sound pressure level P1 at the position of a listener's ear drum caused by a sound source signal s emitted in a space r is calculated in accordance with equation (2) as follows.

$$P1=S\times R\times HRTF(ED)=S\times R\times HRTF(EEC)\times H(EC) \quad (2)$$

wherein S is indicative of sound source signal, R is indicative of room transfer function, HRTF(ED) is indicative of head-related transfer function measured at the position of the ear drum, HRTF(EEC) is indicative of head-related transfer function measured at the position of the entrance of the ear canal, and H(EC) is indicative of ear canal transfer function.

Sound pressure level P2 at the position of the listener's entrance of the ear canal caused by a sound source signal s emitted in a space r is calculated in accordance with equation (3) as follows.

$$P2=S\times R\times HRTF(EEC) \quad (3)$$

Sound pressure level P3 at the position of the listener's ear drum caused by the sound pressure level P2 reproduced by a stereo earphone is calculated in accordance with equation (4) as follows.

$$P3=P2\times SIP\times H(EC_SIP) \quad (4)$$

wherein SIP is indicative of characteristics of the stereo earphone, and H(EC_SIP) is indicative of ear canal transfer function applicable to the state that the stereo earphone is mounted on the outer ear.

Correction values (correction filter) Hc to correct the sound pressure level at the position of the listener's ear drum caused by the sound pressure level P2 reproduced by a stereo earphone, i.e., the sound pressure level P3 to a degree that the sound pressure level P3 becomes equal to the sound pressure level P1 are calculated as follows.

Subtract equation (2) from equation (4) to obtain a following equation.

$$S\times R\times HRTF(EEC)\times H(EC)=S\times R\times HRTF(EEC)\times SIP\times H(EC_SIP)\times Hc \quad (5)$$

Accordingly, $$Hc=H(EC)/\{SIP\times H(EC_SIP)\} \quad (6)$$

As will be seen from the foregoing description, it is to be understood that the sound pressure level P1 at the position of a listener's ear drum caused by a sound source signal s emitted in a space r can be reproduced by way of processing and correcting signals of the sound pressure level P2 with the correction values Hc and reproducing a sound in response to the signal thus corrected by the stereo earphone.

It is required to measure and calculate the correction values Hc in order to correct the standard ear canal transfer function H(EC) to obtain the target ear canal transfer function applicable to the state that the stereo earphone is mounted on the outer ear H(EC_SIP). It is, however, difficult to measure the standard ear canal transfer function H(EC) and the target ear canal transfer function applicable to the state that the stereo earphone is mounted on the outer ear H(EC_SIP). A method of measuring the standard ear canal transfer function H(EC) and the target ear canal transfer function applicable to the state that the stereo earphone is mounted on the outer ear H(EC_SIP) with a dummy head will be described hereinlater.

Preferably, KEMAR produced by Knowles Inc. (M. D. Burkhard and R. M. Sachs, "Anthropometric manikin for acoustic research," J. Acoust. Soc. Am., Vol. 58, No. 1, July 1975) should be used as the dummy head because of the fact that the ear canal transfer function of the dummy head is accurately simulated, and the shapes of the ears are similar to those of human ears.

The ear canal transfer function H(EC) can be obtained with HRTF(ED) and HRTF(EEC) in accordance with equation (7) as follows.

$$H(EC)=HRTF(ED)/HRTF(EEC) \quad (7)$$

HRTF(ED) is measured by microphones placed at the positions of ear drums of the dummy head while, on the other hand, HRTF(EEC) is measured by microphones placed at the positions of the entrances of ear canals of the dummy head. H(EC_SIP) is measured in a manner that microphones, placed at the positions of the ear drums of the dummy head, collect test sounds emitted from the stereo earphone inserted into the entrances of ear canals of the dummy head.

As described hereinearlier, the aforesaid method makes it easier to measure the variation of ear canal impulse responses at the positions of the ear drums resulted from an earphone mounted on the outer ear. The sound image localizing apparatus according to the present invention can generate sound image signals collectively constituting an accurately located sound image by correcting sound signals with reference to the variation of the ear canal impulse responses thus measured in the manner as described earlier.

While it has been described in the above that the sound image localizing apparatus comprises a stereo earphone, the stereo earphone may be replaced with a stereo headphone. It is needless to mention that the sound image localizing apparatus thus constructed can attain the same advantage of accurately calculating the correction values.

The head-related impulse responses are quite different from individual to individual. As will be seen from the foregoing description, it is to be appreciated that the present embodiment of the sound image localizing apparatus according to the present invention is operative to divide head-related impulse responses into front direction head-related impulse responses, which are different from individual to individual, and the rising angle difference information, which are less different from individual to individual, thereby reducing errors resulting from the personal difference in the head-related impulse response, and thus enhancing the accuracy of localizing a sound image.

Assuming that three-dimensional space is divided into, for example, m directions with respect to a horizontal axis and n directions with respect to a vertical axis, and a sound image is to be located to a three-dimensional direction selected from among a plurality of directions of m×n directions, the conventional sound image localizing apparatus is required to store head-related impulse responses for all the directions of m×n directions. The sound image localizing apparatus according to the present invention, on the other hand, is required to store only m units of the lateral angle control information, i.e., m units of interaural time difference information or interaural sound level difference information, or both of them, and n units of the difference information in head-related impulse response between the front direction and other directions in the median plane with respect to rising angles, thereby eliminating the need of measuring and generating head-related impulse responses for all the directions of m×n directions as well as enabling to accurately localize a sound image with a small amount of storage areas.

The sound image localizing apparatus according to the present invention, which is operative to correct an ear canal transfer function in consideration of variations resulted from a headphone or an earphone mounted on an outer ear, can accurately localize a sound image with a small amount of storage areas even though a headphone or an earphone mounted on the listener's outer ear.

Figure 8:
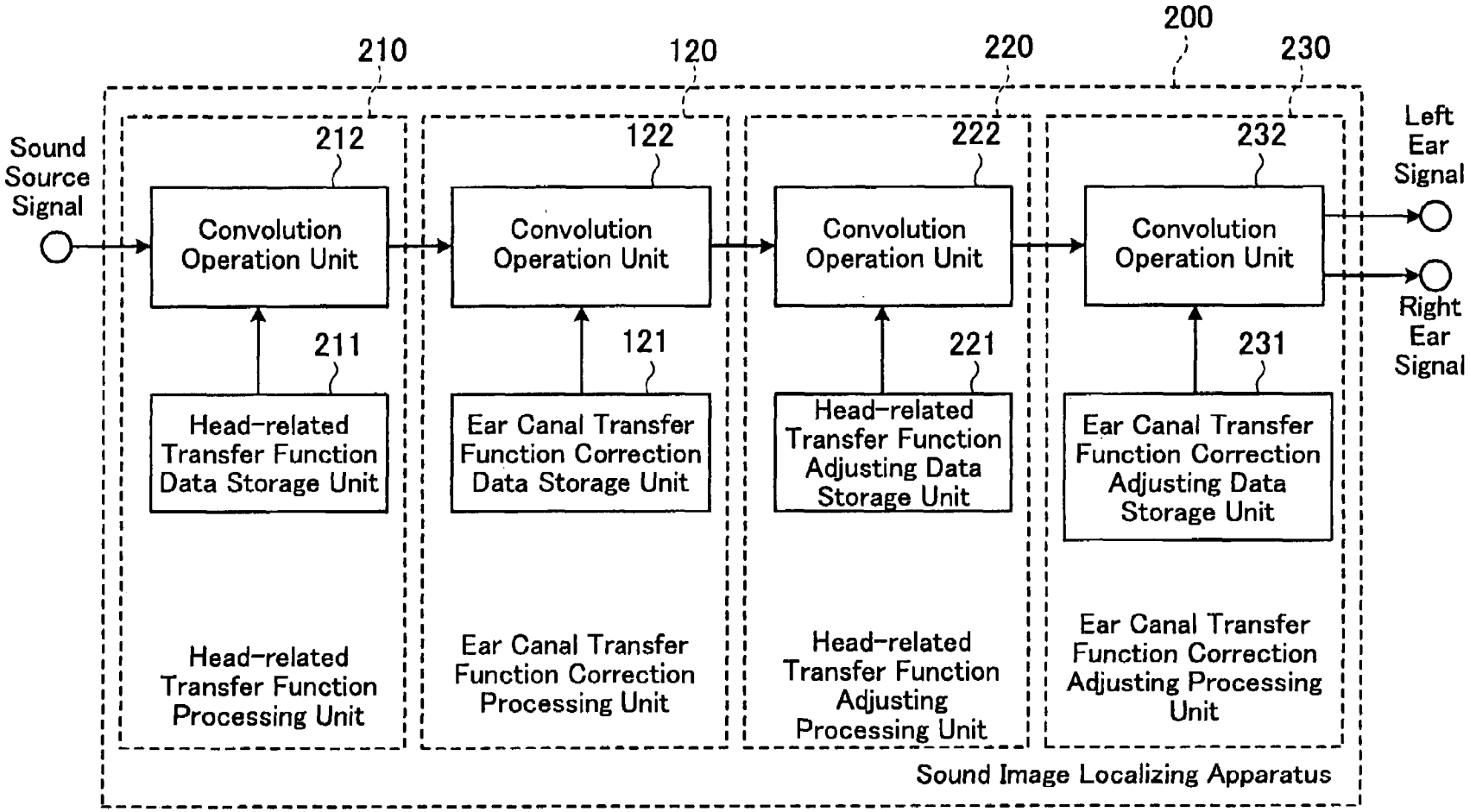
FIG. 8 is a block diagram showing a second preferred embodiment of the sound image localizing apparatus according to the present invention.

Referring then to FIG. 8 of the drawings, there is shown a second preferred embodiment of the sound image localizing apparatus according to the present invention. The present embodiment of the sound image localizing apparatus is substantially similar in construction to the first embodiment of the sound image localizing apparatus. The same constitutional elements are simply represented by the same reference numerals as those of the first embodiment, and will thus be omitted in description for avoiding tedious repetition.

As shown in FIG. 8, the present embodiment of the sound image localizing apparatus 200 comprises a head-related transfer function processing unit 210 for generating sound image signals, for example, two-channel sound signals, collectively constituting the sound image in response to a sound source signal by means of a standard head-related transfer function and a ear canal transfer function, an ear canal transfer function correction processing unit 120 for performing a correction processing on signals outputted from the head-related transfer function processing unit 210 on the basis of ear canal transfer function correction information so as to correct the ear canal transfer function in consideration of variations resulted from a headphone or an earphone mounted on an outer ear to generate corrected sound image signals collectively constituting the sound image, a head-related transfer function adjusting processing unit 220 for adjusting a signal outputted from the head-related transfer function processing unit 210 in a manner of altering the standard head-related transfer function to a target head-related transfer function, in accordance with which the signal is to be processed, and an ear canal transfer function correction adjusting processing unit 230 for correcting a signal outputted from the ear canal transfer function correction processing unit 120 in a manner of adjusting a difference between target ear canal transfer function correction information and standard ear canal transfer function correction information, in accordance with which the ear canal transfer function correction processing unit 120 has performed the correction processing on the signals.

The head-related transfer function processing unit 210 comprises a head-related transfer function data storage unit 211 for storing standard head-related transfer function data, and a convolution operation unit 212, and is operative to obtain appropriate data from the head-related transfer function data storage unit 211, to convolute a sound signal with the standard head-related transfer function data thus obtained by means of the convolution operation unit 212, and to generate sound image signals collectively constituting a sound image in response to a sound source signal by means of a standard head-related transfer function.

The head-related transfer function adjusting processing unit 220 comprises a head-related transfer function adjusting data storage unit 221 for storing head-related transfer function adjusting data indicative of a difference between a target head-related transfer function and a standard head-related transfer function, and a convolution operation unit 222, and is operative to obtain appropriate data from the head-related transfer function adjusting data storage unit 221, and to convolute a sound source signal with the head-related transfer function adjusting data thus obtained by means of the convolution operation unit 222. Preferably, the target head-related transfer function should be, for example, a listener's personal head-related transfer function.

The ear canal transfer function correction adjusting processing unit 230 comprises an ear canal transfer function correction adjusting data storage unit 231 for storing ear canal transfer function correction adjusting data indicative of a difference between target ear canal transfer function correction data and standard ear canal transfer function correction data, and a convolution operation unit 232, and is operative to obtain appropriate data from the ear canal transfer function correction adjusting data storage unit 231, and to convolute a sound source signal with the ear canal transfer function correction adjusting information thus obtained by means of the convolution operation unit 232. Preferably, the target ear canal transfer function correction information should be, for example, ear canal transfer function correction data calculated in consideration a specified headphone or a specified earphone actually mounted on the listener's outer ear.

The second embodiment of the sound image localizing apparatus thus constructed is operative to convolute the sound source signal with the aforesaid data and to output a right-ear signal and a left-ear signal. While it has been described about the above embodiment that a plurality of convolution operation units are provided for respective convolution operations as shown in FIG. 8, the convolution operation units may be integrated to one operation unit.

A method of calculating data used by the ear canal transfer function correction adjusting processing unit 230 will be described hereinlater with reference to the drawings shown in FIG. 9.

An example of amplitude-frequency response characteristics $Hc_1$ of standard ear canal transfer function correction characteristics used by the ear canal transfer function correction processing unit 120 is shown in FIG. 9(*a*). The standard ear canal transfer function correction characteristics $Hc_1$ may be data such as, for example, correction data Hc measured and calculated in accordance with the aforementioned equation (6) with a predetermined standard headphone or a predetermined standard earphone.

An example of amplitude-frequency response characteristics $Hc_2$ of ear canal transfer function correction characteristics measured and calculated with a specified headphone or a specified earphone is shown in FIG. 9(*b*). The specified headphone or the specified earphone will be actually mounted on the listener's outer ear and, and the listener will listen to a sound reproduced by the specified headphone or the specified earphone.

The ear canal transfer function correction characteristics $Hc_2$ is correction data Hc measured and calculated in accordance with the aforementioned equation (6) with the specified headphone or the specified earphone.

As best shown in FIGS. 9(*a*), and (*b*), the amplitude-frequency response characteristics of the standard ear canal transfer function correction characteristics $Hc_1$ and that of the ear canal transfer function correction characteristics $Hc_2$ are similar to each other in shape, but slightly different from each other in the number and frequencies of peaks and dips.

Difference characteristics $Hc_3$ between the standard ear canal transfer function correction characteristics $Hc_1$ shown in FIG. 9(*a*) and the ear canal transfer function correction characteristics $Hc_2$ measured with the specified headphone or the specified earphone shown in FIG. 9(*b*), i.e., ear canal transfer function correction adjusting data, is shown in FIG. 9(*c*), and is calculated in accordance with equation (8) as follows.

$$Hc_3 = Hc_2 / Hc_1 \tag{8}$$

The ear canal transfer function correction adjusting processing unit 230 is operative to adjust a signal processed by the ear canal transfer function correction processing unit 120 in accordance with the difference such as, for example, the difference characteristics between the standard ear canal transfer function correction characteristics $Hc_1$ and the actual ear canal transfer function correction characteristics $Hc_2$ shown in FIG. 9(*c*).

The target ear canal transfer function correction characteristics can be obtained by multiplying the standard ear canal transfer function correction characteristics $Hc_1$ by the difference characteristics $Hc_3$ between the standard ear canal transfer function correction characteristics $Hc_1$ and the actual ear canal transfer function correction characteristics $Hc_2$ in accordance with equation (9), which is derived from equation (8), as follows.

$$Hc_1 \times Hc_3 = Hc_2 \quad (9)$$

As will be seen from the equation above, the target ear canal transfer function correction characteristics thus obtained is equal to the actual ear canal transfer function correction characteristics $Hc_2$.

Data used by the head-related transfer function adjusting processing unit 220 may be calculated on the basis of, for example, difference information between the standard head-related transfer function and the target head-related transfer function specific to the listener in a manner similar to the aforesaid method of calculating the ear canal transfer function correction adjusting data, and therefore omitted in description for avoiding tedious repetition.

As will be seen from the foregoing description, it is to be appreciated that the present embodiment of the sound image localizing apparatus according to the present invention is operative to convolute a sound source signal with a standard head-related transfer function, standard ear canal transfer function correction information, difference data between the head-related transfer function and the target head-related transfer function, and difference data between the standard ear canal transfer function correction information and the target ear canal transfer function correction information, thereby reducing errors resulting from the differences among the individual head-related impulse responses, or the differences in the headphone or the earphone. The sound image localizing apparatus thus constructed can change head-related transfer function adjusting data so as to alter a head-related transfer function to a target head-related transfer function when a listener is changed, and change ear canal transfer function correction adjusting data so as to alter an ear canal transfer function to a target ear canal transfer function when the headphone or the earphone is changed, thereby enabling to accurately localize a sound image.

Figure 10:
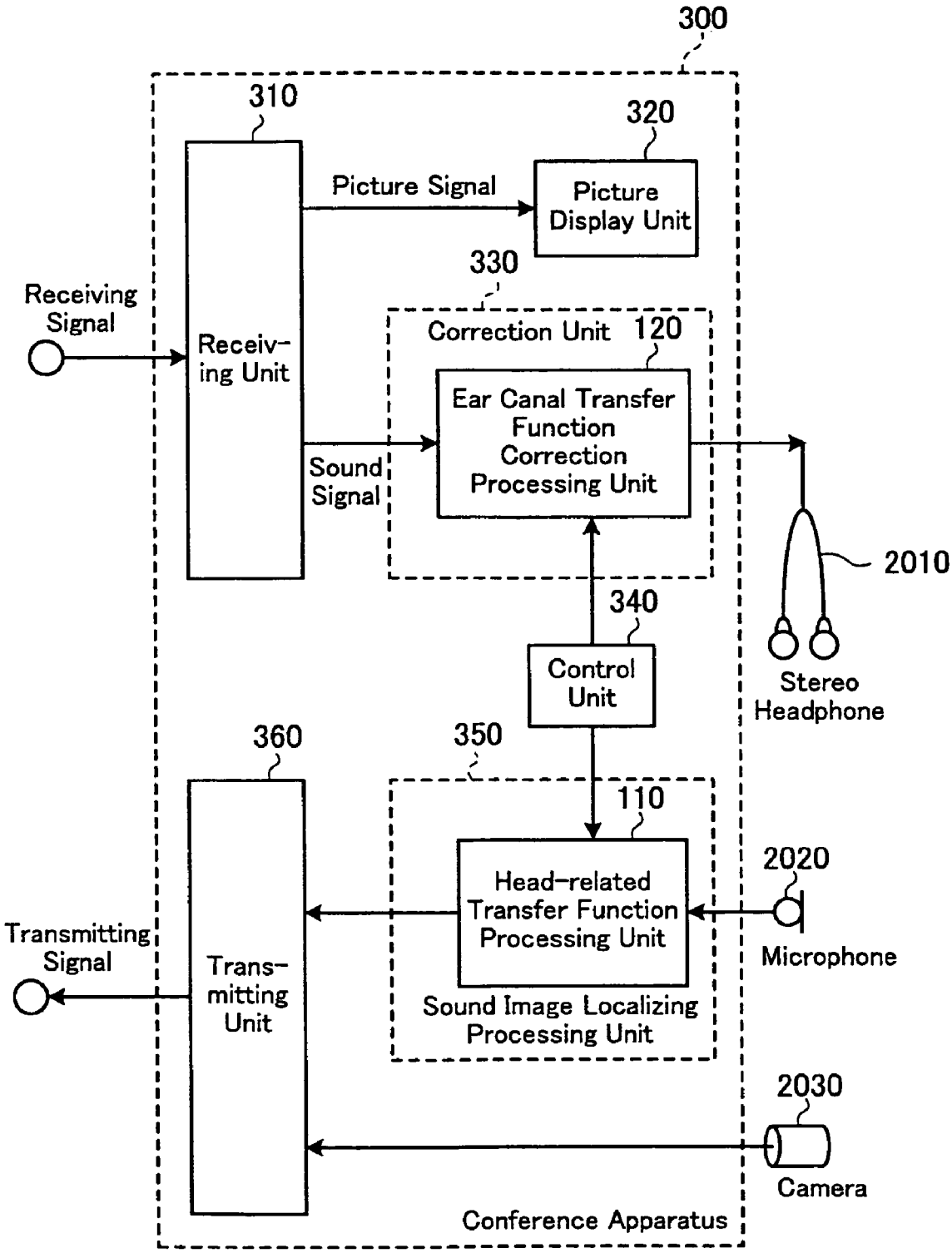
FIG. 10 is a block diagram showing a third preferred embodiment of a conference apparatus according to the present invention.

Referring to the drawings shown in FIG. 10, there is shown a third preferred embodiment of a conference apparatus according to the present invention. The present embodiment of the conference apparatus comprises the first embodiment of the head-related transfer function processing unit 110, and the ear canal transfer function correction processing unit 120.

As shown in FIG. 10, the present embodiment of the conference apparatus 300 comprises a receiving unit 310 for receiving a receiving signal such as, for example, a picture signal and a sound signal, a picture display unit 320 for displaying a picture in response to the picture signal thus received, a correction unit 330 including the first embodiment of the ear canal transfer function correction processing unit 120 for correcting the sound signal thus received in accordance with a listener's condition, a sound image localizing processing unit 350 including the first embodiment of the head-related transfer function processing unit 110 for generating sound image signals collectively constituting a sound image by means of a head-related transfer function, a control unit 340 for controlling the correction unit 330 and the sound image localizing processing unit 350, and a transmitting unit 360 for transmitting a sound signal and picture signal. The correction unit 330 is connected with a stereo headphone 2010 for reproducing a sound in response to a sound signal. The sound image localizing processing unit 350 is connected with a microphone 2020 for collecting a sound. The transmitting unit 360 is connected with a camera 2030 for taking a picture to be converted to a picture signal.

The receiving unit 310 and the transmitting unit 360 are connected with a transmission path. The conference apparatus 300 is adapted to transmit and receive signals with other conference apparatuses, not shown, through the transmission path.

In the conference apparatus 300 thus constructed, the receiving unit 310 is operated to input a receiving signal including, for example, a picture signal and a sound signal, to divide the receiving signal into the picture signal and the sound signal, and to output the picture signal to the picture display unit 320 and the sound signal to the correction unit 330. The control unit 340 is operated to control the correction unit 330, and the correction unit 330 is operated to adjust the sound signal in a manner of correcting an ear canal transfer function, in accordance with which the sound signal is to be processed, with reference to the characteristics of the stereo headphone 2010, and output the thus adjusted sound signal to the stereo headphone 2010.

It is assumed that a user of the conference apparatus 300, hereinlater referred to simply as "a speaker", operates the conference apparatus 300 with the stereo headphone 2010 mounted on his or her outer ear, and speaks into the microphone 2020. The microphone 2020 is operated to collect the speaker's voice to be converted to a sound signal, and to output the sound signal to the sound image localizing processing unit 350.

The control unit 340 is operated to control the sound image localizing processing unit 350, and the sound image localizing processing unit 350 is operated to generate sound image signals collectively constituting a sound image, and to output the sound image signals to the transmitting unit 360. The camera 2030 is operated to take a speaker's picture, and to convert the picture into a picture signal to be outputted to the transmitting unit 360.

The transmitting unit 360 is operated to transmit the picture signal inputted from the camera 2030 and sound image signals inputted from the sound image localizing processing unit 350 to another conference apparatus, which is not shown.

In the present embodiment of the conference apparatus, the sound image localizing processing unit is operative to process a signal to be transmitted, hereinlater referred to as a "transmitting signal", by means of the head-related transfer function, and the correction unit is operative to process a received signal with reference to the characteristics of the stereo headphone mounted on the speaker's outer ear. From the foregoing description, it is to be understood that the present embodiment of the conference apparatus thus constructed can properly generate corrected sound image signals collectively constituting an accurately localized sound image in response to the received signal transmitted from another conference apparatus, which does not know the characteristics of the stereo headphone of the receiving conference apparatus, thereby enabling to accurately localize a sound image.

Sounds are emitted by, for example, a plurality of loudspeakers in response to sound image signals; a listener cannot accurately recognize a direction of a sound image collectively constituted by the sounds unless the listener is placed at a position equally spaced apart from the loudspeakers disposed to surround the listener. The listener, on the other hand, can accurately recognize a direction of a sound image collectively constituted by sounds emitted form the stereo headphone 2010 in response to the sound image signals thus generated regardless of where the listener is placed.

Furthermore, sounds emitted by a loudspeaker may be collected by a microphone, thereby causing an acoustic echo. In the present embodiment of the conference apparatus, a sound emitted by the stereo headphone 2010, on the other hand, will not be collected by a microphone, thereby causing no acoustic echo as well as realizing a comfortable conference.

Figure 11:
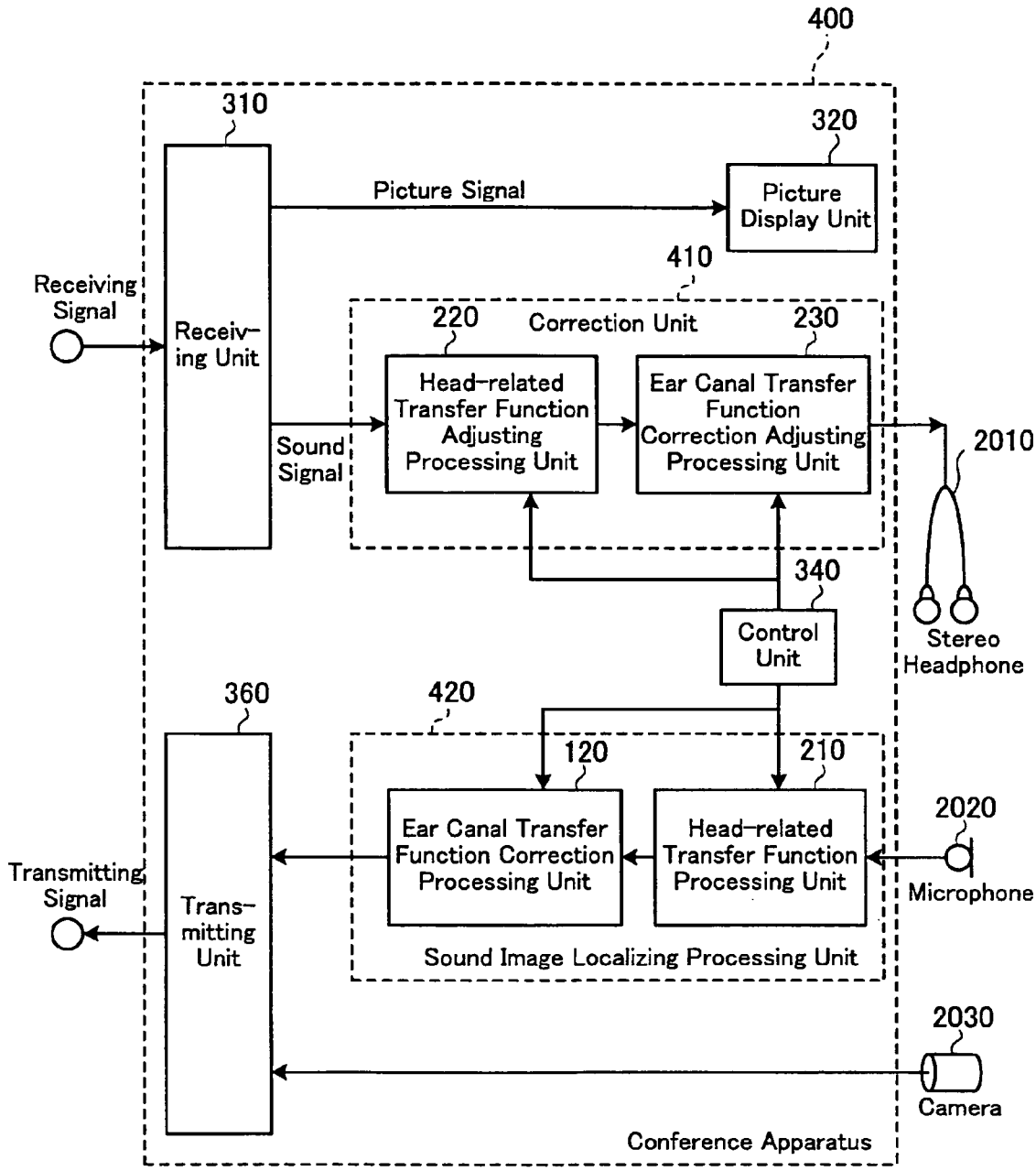
FIG. 11 is a block diagram showing a modified third preferred embodiment of the conference apparatus according to the present invention.

Referring to FIG. 11 of the drawings, there is shown a modified third embodiment of the conference apparatus comprising a correction unit 410 including at least on of the aforesaid second embodiments of the head-related transfer function adjusting processing unit 220 and the ear canal transfer function correction adjusting processing unit 230, and a sound image localizing processing unit 420 including the aforesaid second embodiment of head-related transfer function processing unit 210 and the ear canal transfer function correction processing unit 120.

The head-related transfer function processing unit 210 is operated to generate first sound image signals collectively constituting a sound image by means of convoluting a sound signal to be transmitted with a standard head-related transfer function. The ear canal transfer function correction processing unit 120 is operated to convolute the first sound image signals outputted from the head-related transfer function processing unit 210 with standard ear canal transfer function correction information.

The head-related transfer function adjusting processing unit 220 is operated to process a received signal in a manner of adjusting a difference between a target head-related transfer function and the standard head-related transfer function. The ear canal transfer function correction adjusting processing unit 230 is operated to process a signal outputted from the head-related transfer function adjusting processing unit 220 or the receiving unit 310 in a manner of adjusting a difference between target ear canal transfer function correction information and standard ear canal transfer function correction information.

The conference apparatus thus constructed can perform a sound image localizing processing on a transmitting sound signal by means of a standard head-related transfer function and a standard ear canal transfer function correction information, and perform a correction processing on a received sound signal with reference to the characteristics of a listener and a stereo headphone to be mounted on the listener, thereby enabling to properly process a received sound signal transmitted from another conference apparatus, which does not know the characteristics of the receiving state such as, for example, the type of the stereo headphone, thereby enabling to accurately localize a sound image.

Figure 12:
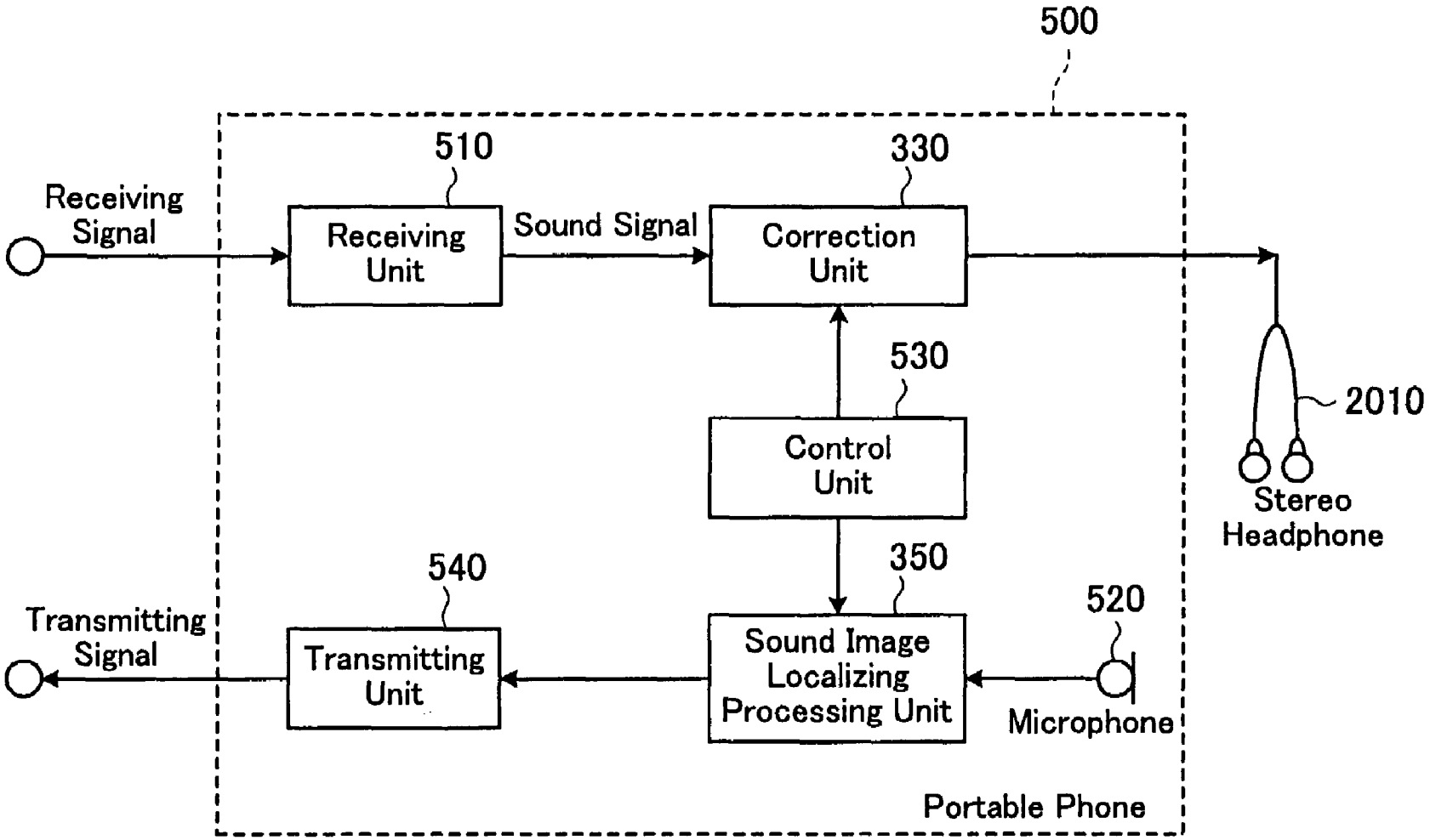
FIG. 12 is a block diagram showing a fourth preferred embodiment of a portable phone according to the present invention.

Referring then to FIG. 12 of the drawings, there is shown a fourth preferred embodiment of a portable phone. The present embodiment of the portable phone comprises the aforesaid third embodiments of the correction unit 330 and the sound image localizing processing unit 350.

As shown in FIG. 12, the present embodiment of the portable phone 500 comprises a receiving unit 510 for receiving a receiving signal including, for example, a sound signal, a correction unit 330 for correcting the sound signal thus received with reference to the characteristics of the receiving state, a microphone 520 for collecting a sound such as, for example, a voice to be converted to a sound signal, a sound image localizing processing unit 350 for performing a sound image localizing processing on the sound signal outputted from the microphone 520, a control unit 530 for controlling the correction unit 330 and the sound image localizing processing unit 350, and a transmitting unit 540 for transmitting a sound signal outputted from the sound image localizing processing unit 350. The correction unit 330 is connected with a stereo headphone 2010 for reproducing a sound in response to a sound signal outputted from the correction unit 330.

In the portable phone 500 thus constructed, the receiving unit 510 is operated to receive, for example, a sound signal; the correction unit 330 is operated to correct the sound signal thus received with reference to characteristics of a user of the portable phone 500 and the stereo headphone 2010 in the same manner as described in the above third embodiment, and to output the thus corrected sound signal to the stereo headphone 2010.

The user of the portable phone 500 operates the portable phone 500 with the stereo headphone 2010 mounted on his or her outer ear, and speaks into the microphone 520. The microphone 520 is operated to collect the user's voice to be converted to a sound signal, and to output the sound signal to the sound image localizing processing unit 350. The sound image localizing processing unit 350 is operated to perform a sound image localizing processing on the sound signal, and to output the sound image signals to the transmitting unit 360 in the same manner as described in the above third embodiment.

The control unit 530 is designed to control the correction unit 330 so that the correction unit 330 can perform a correction processing at an optimal condition, and to control the sound image localizing processing unit 350 so that the sound image localizing processing unit 350 can perform a sound image localizing process at an optimal condition.

As will be seen from the foregoing description, it is to be appreciated that the present embodiment of the portable phone, which is operative to perform a sound image localizing processing on a transmitting sound signal by means of the head-related transfer function, and to perform a correction processing on a received sound signal with reference to the characteristics of a listener and a stereo headphone to be mounted on the listener, can properly process the received sound signal transmitted from another portable phone, which does not know the characteristics of the receiving state such as, for example, the stereo headphone, thereby enabling to accurately localize a sound image.

Furthermore, in the portable phone according to the present invention, the present embodiment of the correction unit 330 may be replaced by the modified third embodiment of the correction unit 410 and the present embodiment of the sound image localizing processing unit 350 may be replaced by the modified third embodiment of the sound image localizing processing unit 420.

Figure 13:
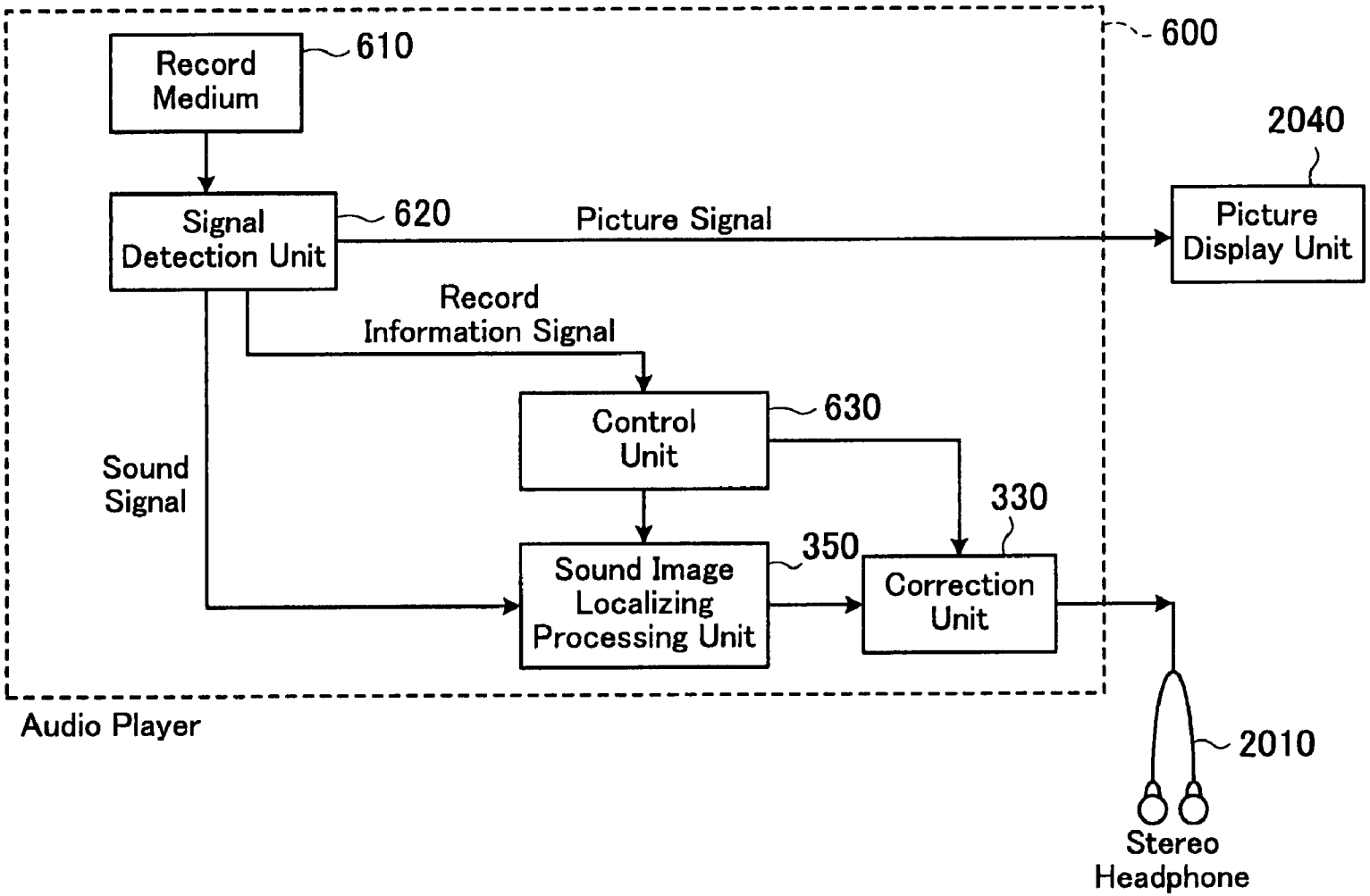
FIG. 13 is a block diagram showing a fifth preferred embodiment of an audio player apparatus according to the present invention.

Referring to the FIG. 13 of the drawings, there is shown a fifth preferred embodiment of the audio player according to the present invention. The present embodiment of the audio player comprises the aforesaid third embodiments of the correction unit 330 and the sound image localizing processing unit 350.

As shown in FIG. 13, the present embodiment of the audio player 600 comprises a sound image localizing processing unit 350 for generating a plurality of sound image signals collectively constituting a sound image located in specified directions, a correction unit 330 for correcting the sound image signals thus generated with reference to characteristics of a listener of the audio player 600 and a stereo headphone 2010, which will be described later, a signal detection unit 620 for detecting signals such as, for example, a sound signal, a picture signal, and a record information signal recorded on a record medium 610 such as, for example, CD, DVD, or the like, and a control unit 630 for controlling the sound image localizing processing unit 350 and the correction unit 330 in response to the record information signal recorded on the record medium 610.

The signal detection unit 620 is connected with a picture display unit 2040 for displaying a picture in response to a picture signal, and the correction unit 330 is connected with the stereo headphone 2010 for reproducing a sound in response to a sound signal.

In the audio player 600 thus constructed, the signal detection unit 620 is operated to detect sound signals of a plurality of channels, picture signals, and record information signals such as, for example, the number of sound signal channels and sound image localizing information form the record medium 610 such as, for example, CD, DVD, or the like, for storing a plurality of picture signals, sound signals, and record information signals therein.

The picture display unit 2040 is operated to display a picture in response to the picture signal detected by the signal detection unit 620. The signal detection unit 620 is operated to output the sound signal to the sound image localizing processing unit 350, and to output the record information signal to the control unit 630.

The record information signal includes sound image localizing information if no sound image localizing processing has been performed on the pertinent sound signal. The control unit 630 is operated to determine sound image directions most appropriate for the sound signal on the basis of the sound image localizing information included in the record information signal, and to control the sound image localizing processing unit 350 in accordance with the sound image directions thus determined. Preferably, the sound image localizing processing unit 350 should judge to perform no sound image localizing processing on a sound signal readout from the record medium if no sound image localizing information is included in the record information signal, while, on the other hand, the sound image localizing processing unit 350 should judge to perform a sound image localizing processing on a sound signal readout from the record medium if the record information signal includes sound image localizing information.

The correction unit 330 is operated to perform a correction processing on a signal outputted from the sound image localizing processing unit 350 with reference to the characteristics of a listener and a stereo headphone 2010 to be mounted on the listener regardless of whether the sound image localizing processing unit 350 has performed a sound image localizing processing to the signal or not, and to output a signal to the stereo headphone 2010.

As will be seen from the foregoing description, it is to be appreciated that the present embodiment of the audio player thus constructed can optimally control the directions of the sound image on the basis of a record information signal such as, for example, the number of sound signal channels and sound image localizing information recorded on the record medium, thereby enabling to control sound image directions most appropriate for the sound signal recorded on the record medium as well as eliminating a need of relocating loudspeaker.

Sounds are emitted by, for example, a plurality of loudspeakers in response to sound image signals; a listener cannot accurately recognize a direction of a sound image collectively constituted by the sounds unless the listener is placed at a position equally spaced apart from the loudspeakers disposed to surround the listener. The listener, on the other hand, can accurately recognize a direction of a sound image collectively constituted by sounds emitted form the stereo headphone of the present embodiment of the audio player in response to sound image signals regardless of where the listener is placed. This leads to the fact that a listener carrying the present embodiment of a small-sized audio player and listening to sounds, for example, music, reproduced by the audio player can appreciate the music with enhanced realistic sensations.

Furthermore, the present embodiment of the audio player can optimally correct and adjust directions of a sound image with reference to characteristics of a listener of the audio player and the stereo headphone.

Furthermore, in the audio player according to the present invention, the present embodiment of the correction unit 330 may be replaced by the modified third embodiment of the correction unit 410 and the present embodiment of the sound image localizing processing unit 350 may be replaced by the modified third embodiment of the sound image localizing processing unit 420.

Figure 14:
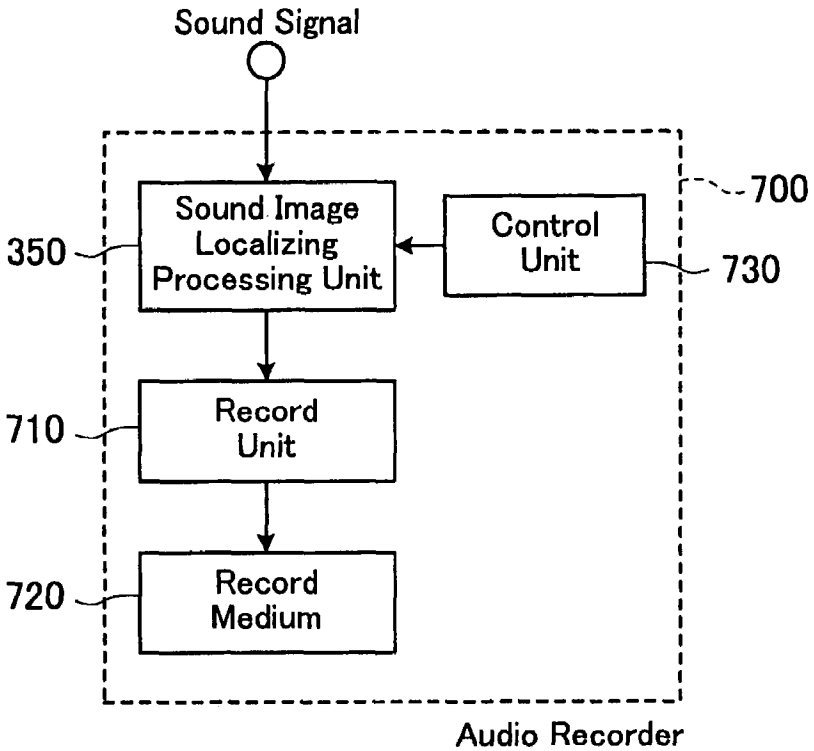
FIG. 14 is a block diagram showing a sixth preferred embodiment of an audio recorder apparatus according to the present invention.

Referring to FIG. 14 of the drawings, there is shown a sixth preferred embodiment of the audio recorder according to the present invention. The present embodiment of the audio recorder comprises the aforesaid third embodiment of the sound image localizing processing unit 350.

As shown in FIG. 14, the present embodiment of the audio recorder 700 comprises a sound image localizing processing unit 350 for generating a plurality of sound image signals, for example, two-channel sound signals, collectively constituting a sound image located in specified directions, a record unit 710 for recording the sound image signals, for example, two-channel sound signals on a record medium, a record medium 720 such as, for example, CD, DVD, and a control unit 730 for specifying sound image directions of the sound image collectively constituted by sound image signals generated by the sound image localizing processing unit 350.

In the audio recorder 700, the sound image localizing processing unit 350 is operated to perform a sound image localizing processing on an inputted signal, and to generate, for example, two-channel sound signals collectively constituting a sound image located in directions specified by the control unit 730. The control unit 730 is operated to specify the directions of the sound image to be constituted by sound image signals, for example, two-channel signals, so that a listener can optimally listen to sounds as if the listener is listening to the sounds at a position equally spaced apart from a plurality of loudspeakers disposed to surround the listener. The record unit 710 is operated to record the two-channel signals outputted from the sound image localizing processing unit 350 on the record medium 720.

As will be seen from the foregoing description, it is to be appreciated that the present embodiment of the audio recorder, in which the sound image localizing processing unit 350 is operative to generate sound signals collectively constituting a sound image located in directions specified by the control unit 730 so that a listener can optimally listen to sounds, and the record unit 710 is operative to record the sound signals thus generated by the sound image localizing processing unit 350, makes it possible for an audio player to reproduce sounds optimally audible to a listener without performing additional processing such as, for example, a sound image localizing processing, on the sound signals.

In the present embodiment of the audio recorder, the sound image localizing processing unit 350 is operated to generate two-channel sound signals collectively constituting a sound image. The audio recorder thus constructed can output two-channel sound signals in response to sound signals of more than two channels so that the stereo headphone can reproduce sounds collectively constituting a sound image, thereby enabling to reduce an amount of storage areas in the record medium.

Furthermore, in the audio recorder according to the present invention, the present embodiment of the sound image localizing processing unit 350 may be replaced by the modified third embodiment of the sound image localizing processing unit 420.

Figure 15:
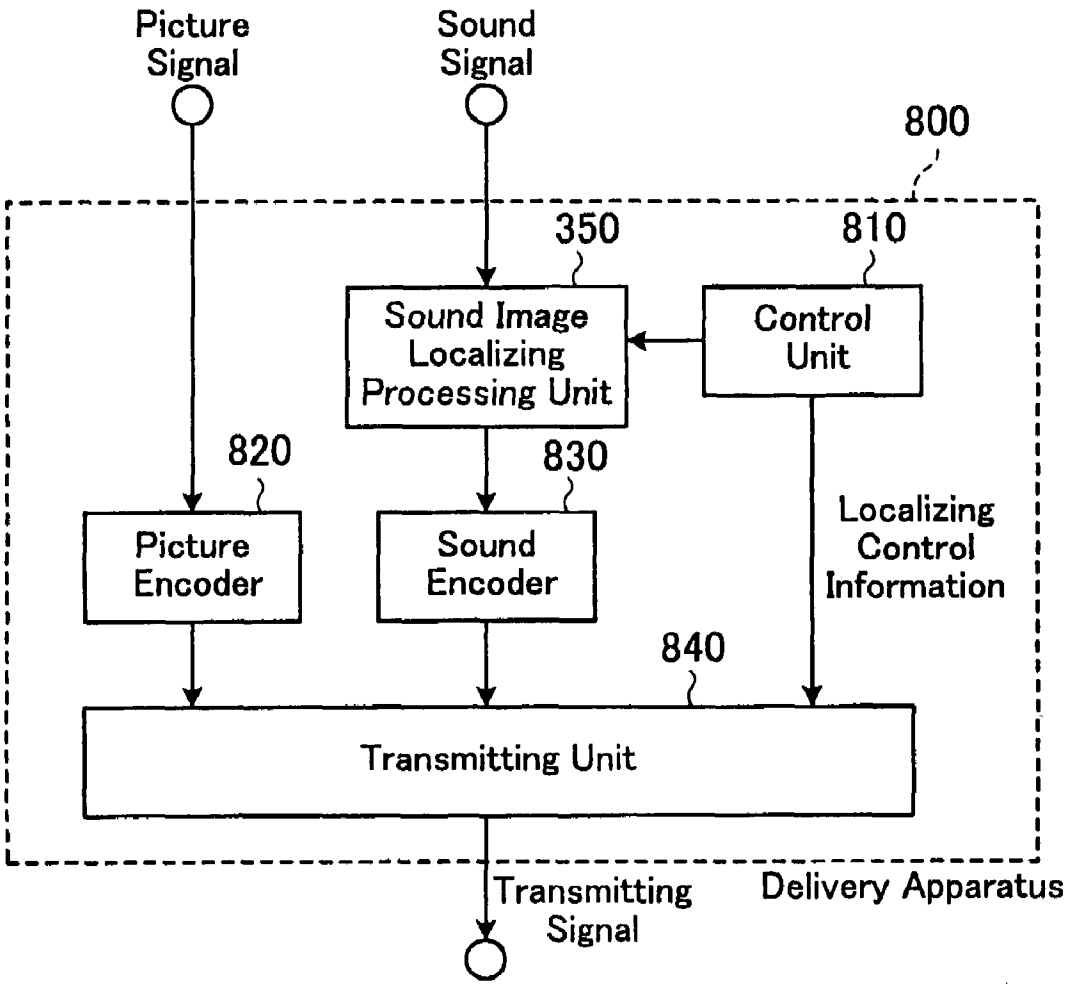
FIG. 15 is a block diagram showing a seventh preferred embodiment of a delivery apparatus according to the present invention.

Referring to FIG. 15 of the drawings, there is shown a seventh preferred embodiment of a delivery apparatus according to the present invention. The present embodiment of the delivery apparatus comprises the aforesaid third embodiment of the sound image localizing processing unit 350.

As shown in FIG. 15, the present embodiment of the delivery apparatus 800 comprises a sound image localizing processing unit 350 for generating a plurality of sound image signals collectively constituting a sound image located in specified directions, a control unit 810 for specifying directions of the sound image collectively constituted by the sound signals, a picture encoder 820 for compressing an amount of data contained in a picture signal, and a sound encoder 830 for compressing an amount of data contained in a sound signal, and a transmitting unit 840 for transmitting signals outputted from the picture encoder 820, the sound encoder 830, and the control unit 810.

In the delivery apparatus 800 thus constructed, the sound image localizing processing unit 350 is operated to perform a sound image localizing processing on a sound signal inputted therein, and to generate sound image signals, i.e., two-channel sound signals collectively constituting a sound image by means of a head-related transfer function in the directions specified by the control unit 810. The control unit 810 is operated to specify the directions of the sound image to be constituted by two-channel sound signals, in response to sound signals, for example, multi-channel sound signals, so that a listener can optimally listen to sounds as if the listener is listening to the sounds at a position equally spaced apart from a plurality of loudspeakers disposed to surround the listener, and to output sound image localizing information to the sound image localizing processing unit 350.

The sound encoder 830 is operated to compress an amount of data contained in the two-channel sound signals outputted from the sound image localizing processing unit 350, and to output compressed sound signals to the transmitting unit 840.

The picture encoder 820 is operated to compress the amount of data contained in picture signals, and to output compressed picture signals to the transmitting unit 840. The control unit 810 is operated to output the sound image localizing information, in accordance with which the sound image localizing processing unit 350 is operated to perform a sound image localizing processing on sound signals inputted therein, to the transmitting unit 840. If required, the picture encoder 820 and/or the sound encoder 830 may not compress an amount of data contained in the picture signal and/or the sound signal.

The transmitting unit 840 is operated transmit the picture signal and the sound signal in a predetermined signal form such as, for example, a compressed data format, in combination with the sound image localizing information, via networks such as, for example, an Internet connection, a radio wave, a telephone line, and the like.

As will be seen from the foregoing description, it is to be understood that the present embodiment of the delivery apparatus according to the present invention, in which the sound image localizing processing unit 350 is operative to perform a sound image localizing processing on a sound signal so that a listener can optimally listen to sounds, before the sound signal is transmitted, makes it possible for a receiving machine to reproduce sounds optimally audible to a listener without performing additional processing such as, for example, a sound image localizing processing, on the sound signals.

The present embodiment of the delivery apparatus is operative to transmit sound image localizing information in combination with a sound signal, thereby enabling a receiving machine to perform an optimal correction processing on the sound signal in accordance with the sound image localizing information.

In the present embodiment of the delivery apparatus, the sound image localizing processing unit 350 is operated to generate two-channel sound signals collectively constituting a sound image. The delivery apparatus thus constructed can output two-channel sound signals in response to sound signals of more than two channels so that a stereo headphone can reproduce sounds collectively constituting a sound image, thereby enabling to reduce an amount of data to be transmitted.

Furthermore, in the delivery apparatus according to the present invention, the present embodiment of the sound image localizing processing unit may be replaced by the modified third embodiment of the sound image localizing processing unit 420.

Figure 16:
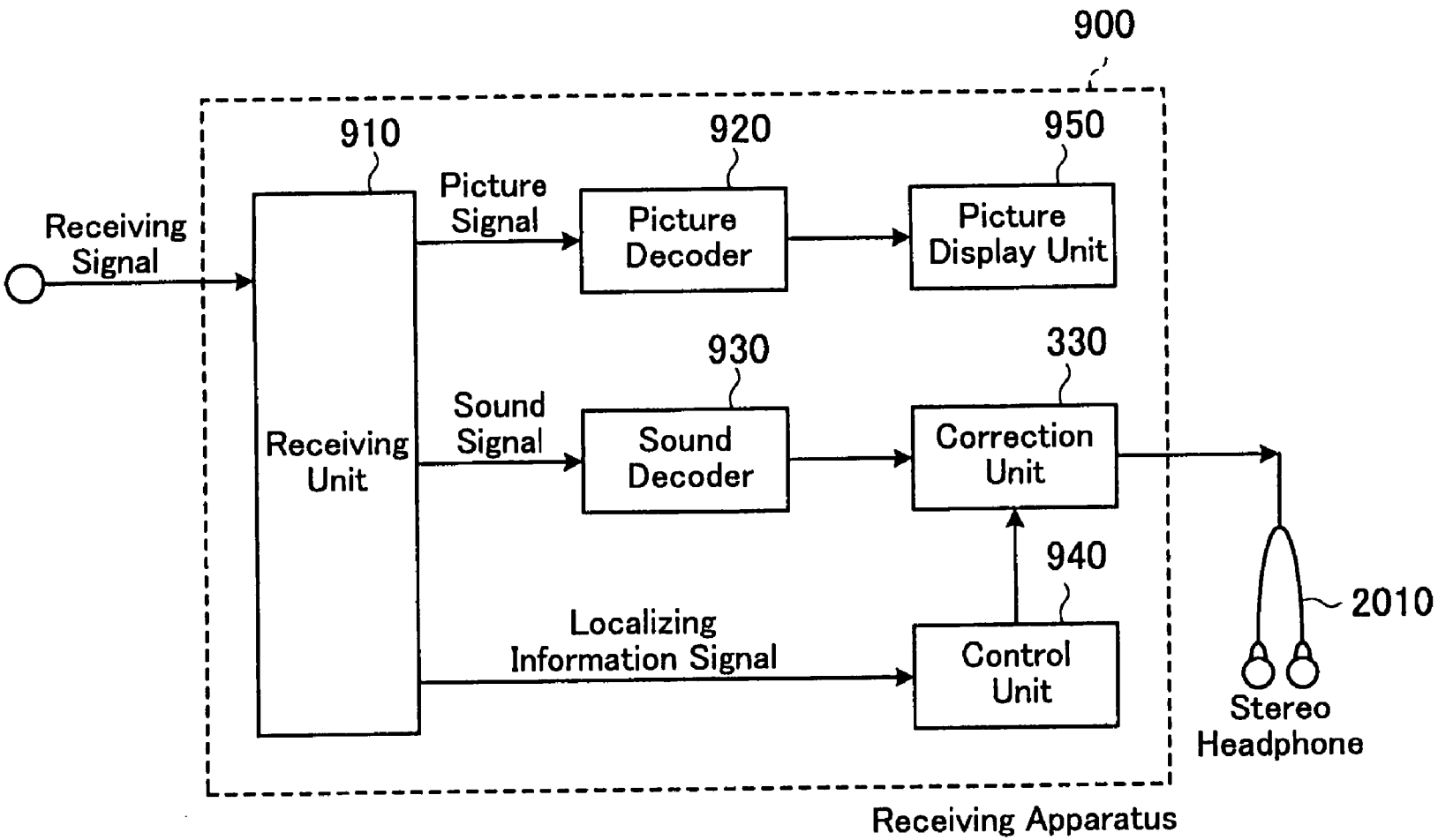
FIG. 16 is a block diagram showing an eighth preferred embodiment of a receiving apparatus according to the present invention.

Referring to FIG. 16 of the drawings, there is shown an eighth preferred embodiment of a receiving apparatus according to the present invention. The present embodiment of the receiving apparatus comprises the aforesaid third embodiment of the correction unit 330.

As shown in FIG. 16, the present embodiment of the receiving apparatus 900 comprises a correction unit 330 for correcting a sound signal by correcting a sound image localizing control function, in accordance with which the sound signal is to be generated, for example, an ear canal transfer function with reference to the characteristics of a listener, and a listener's environment, a receiving unit 910 for receiving a signal via networks such as, for example, an Internet connection, a radio wave, a telephone line, and the like, a picture decoder 920 for decoding a received encoded picture signal, a sound decoder 930 for decoding a received encoded sound signal, a control unit 940 for controlling the correction unit 330, and a picture display unit 950 for displaying a picture in response to a picture signal. The correction unit 330 is connected with a stereo headphone 2010 for reproducing a sound in response to a sound signal.

In the receiving apparatus 900 thus constructed, the receiving unit 910 is operated to receive a receiving signal including a picture signal, a sound signal and sound image localizing information related to the sound signal via networks such as, for example, an Internet connection, and to divide the receiving signal into the picture signal, the sound signal and the sound image localizing information to be outputted respectively to the picture decoder 920, the sound decoder 930, and the control unit 940.

The picture decoder 920 is operated to decode the picture signal outputted from the receiving unit 910, and to output a picture signal thus decoded to the picture display unit 950. The picture display unit 950 is operated to display a picture in response to the decoded picture signal. The sound decoder 930 is operated to decode the sound signal outputted from the receiving unit 910, and to output a sound signal thus decoded to the correction unit 330.

The control unit 940 is operated to determine an optimal sound image localizing processing with reference to the sound image localizing information, the receiving state, the received sound signal, and to control the correction unit 330.

The correction unit 330 is operated to correct the sound signal received from the sound decoder 930 on the basis of ear canal transfer function correction information obtained from the sound image localizing information, in consideration of variations resulted from a headphone or an earphone mounted on a listener's outer ear to generate corrected sound image signals, for example, two-channel sound signals, collectively constituting a sound image, in response to controls from the control unit 940. The stereo headphone 2010 is operated to reproduce a sound in response to the sound signals outputted from the correction unit 330.

As will be seen from the foregoing description, it is to be understood that the present embodiment of the receiving apparatus is operative to optimally correct signals obtained by way of, for example, via Internet, broadcasting, or the like, with reference to the received localizing information, and the characteristics of the stereo headphone 2010, thereby enabling to generate corrected sound image signals, for example, two-channel sound signals, collectively constituting a sound image accurately located.

Furthermore, in the receiving apparatus according to the present invention, the present embodiment of the correction unit may be replaced by the modified third embodiment of the correction unit 410.

Figure 17:
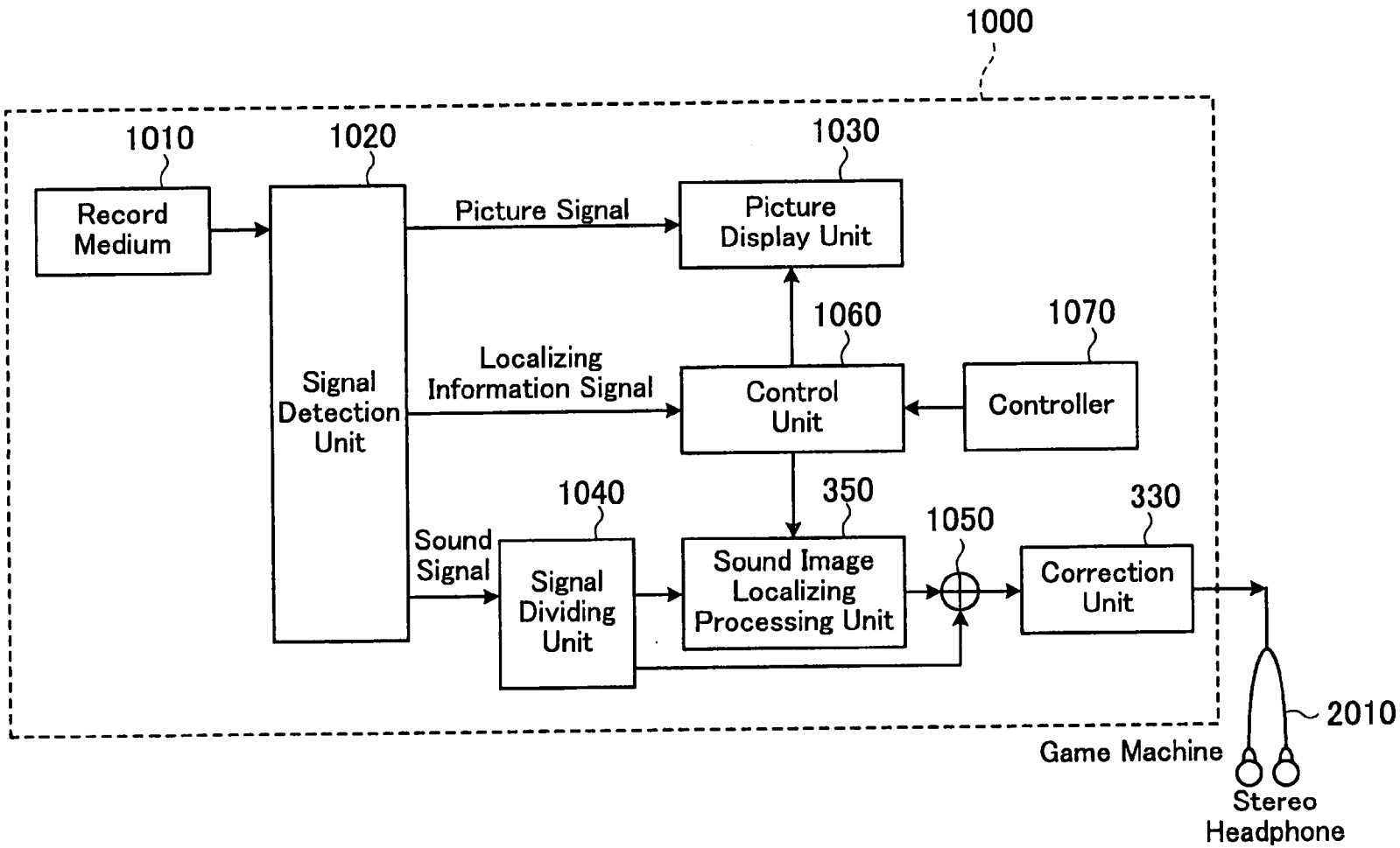
FIG. 17 is a block diagram showing a ninth preferred embodiment of a game machine according to the present invention.

Referring to FIG. 17 of the drawings, there is shown a ninth preferred embodiment of a game machine according to the present invention. The present embodiment of the game machine comprises the aforesaid third embodiments of the correction unit 330 and the sound image localizing processing unit 350.

As shown in FIG. 17, the present embodiment of the game machine 1000 comprises a sound image localizing processing unit 350 for generating a plurality of sound image signals, for example, two-channel sound signals, collectively constituting a sound image located in specified directions, a correction unit 330 for correcting the sound image signals thus generated in a manner of correcting a difference between a standard characteristic and a target characteristic, a record medium 1010 such as, for example, CD, DVD, memory, hard disk, or the like, for recording game software, picture signals, sound signals, record information signals, or the like, a signal detection unit 1020 for detecting picture signals, sound signals, and record information signals from the record medium 1010, a picture display unit 1030 for displaying a picture in response to the picture signal thus detected, a signal dividing unit 1040 for dividing the sound signals into "sound image signals", on which a sound image localizing processing has been performed, and "other sound signals", on which a sound image localizing processing has not been performed, an adding unit 1050 for adding a signal outputted from the sound image localizing processing unit 350 to a signal outputted from the signal dividing unit 1040, a control unit 1060 for specifying the direction of the sound image collectively constituted by the sound image signals to be generated by the sound image localizing processing unit 350, and controlling the picture displayed in the picture display unit 1030, and a controller 1070. The correction unit 330 is connected with a stereo headphone 2010 for reproducing a sound in response to a sound signal.

In the game machine 1000 thus constructed, the signal detection unit 1020 is operated to detect picture signals, sound signals, and record information signals, i.e., localizing information signal, from among information recorded on the record medium 1010. The picture display unit 1030 is operated to display a picture in response to the picture signals thus detected. The signal dividing unit 1040 is operated to input the sound signals, to divide the sound signals thus inputted into "sound image signals", on which a sound image localizing processing has been performed, and "other sound signals", on which a sound image localizing processing has not been performed, and to output the sound image signals to the adding unit 1050, and the other sound signals to the sound image localizing processing unit 350.

The control unit 1060 is operated to input the localizing information signals from the signal detecting unit 1020, and to determine directions of the sound image collectively constituted by the sound image signals generated by the sound image localizing processing unit 350.

A user operates, for example, a start button, and arrow keys on the controller 1070, the controller 1070 transmits signals indicative of the user's operations to the control unit 1060. The control unit 1060 is operated to change pictures to be displayed on the picture display unit 1030 and to specify the directions of the sound image constituted by the sound image signals to be generated by the sound image localizing processing unit 350 in accordance with the signals transmitted from the controller 1070.

The sound image localizing processing unit 350 is operated to perform a sound image localizing processing on "the other sound signals" divided by the signal dividing unit 1040 to generate a plurality of sound image signals, for example, two-channel sound signals, collectively constituting a sound image located in the direction specified by the control unit 1060.

The adding unit 1050 is operated to input a signal outputted from the sound image localizing processing unit 350 and a signal outputted from the signal dividing unit 1040. The adding unit 1050 is operated to add the signal outputted from the sound image localizing processing unit 350 to the signal outputted from the signal dividing unit 1040, and to generate a signal to be outputted to the correction unit 330.

The correction unit 330 is operated to perform a correction processing on the signal outputted from the adding unit 1050 with reference to the characteristics of the user and the stereo headphone 2010 of the game machine 1000. The stereo headphone 2010 is operated to reproduce sounds in response to a signal outputted from the correction unit 330.

As will be seen from the foregoing description, it is to be understood that the present embodiment of the game machine 1000 is operative to generate sound image signals collectively constituting a sound image in response to the localizing information signal recorded on the record medium 1010 and the user's operation of the controller, and the stereo headphone 2010 is operative to reproduce sounds collectively constituting the sound image located in a three-dimensional direction in response to the sound image signals, thereby making it possible for the user to optimally listen to the sounds regardless of where the user is placed. Furthermore, the present embodiment of the game machine is operative to perform a correction processing with reference to the characteristics of the user and the stereo headphone 2010, thereby making it possible to reproduce sounds collectively constitute the sound image located in a three-dimension accurately as designed by a software designer.

Furthermore, in the game machine according to the present invention, the third embodiment of the correction unit may be replaced by the modified third embodiment of the correction unit 410 and the third embodiment of the sound image localizing processing unit may be replaced by the modified third embodiment of the sound image localizing processing unit 420.

Figure 18:
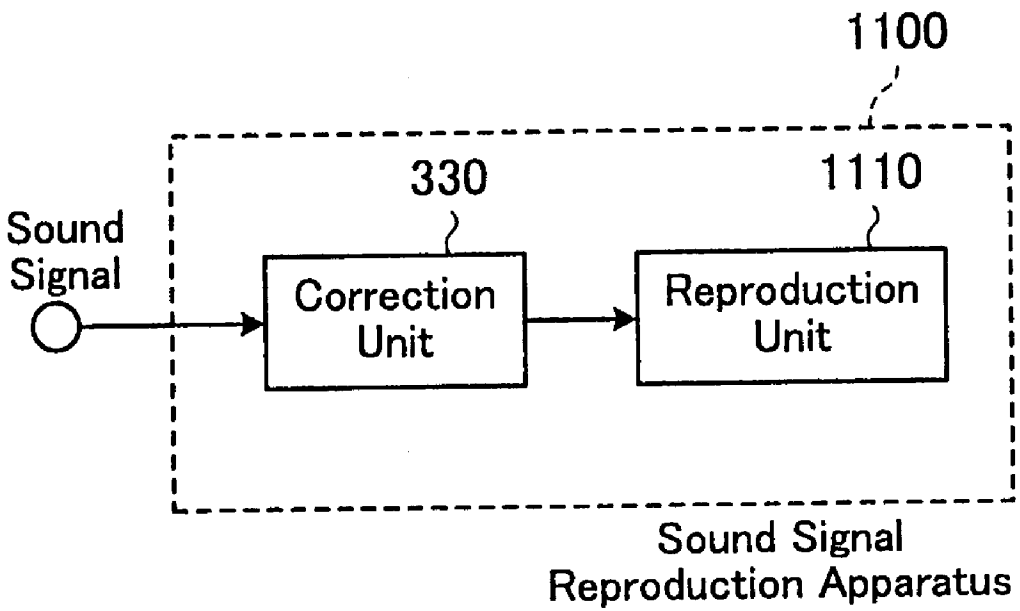
FIG. 18 is a block diagram showing a tenth preferred embodiment of a sound signal reproduction apparatus according to the present invention.
Figure 19:
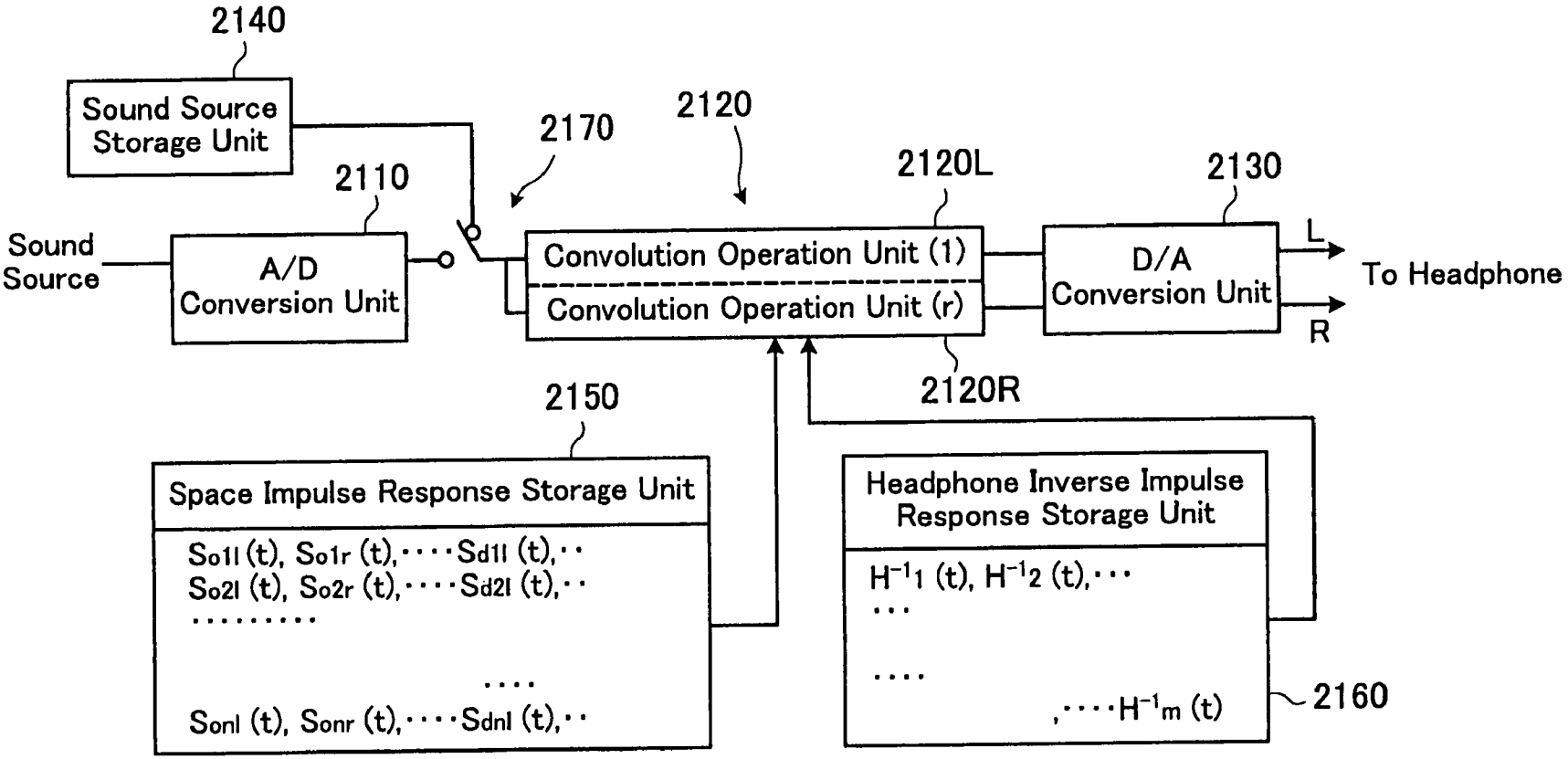
FIG. 19 is a block diagram showing the conventional sound image localizing apparatus.

Referring to FIG. 18 of the drawings, there is shown a tenth preferred embodiment of a sound signal reproduction apparatus 1100 according to the present invention. The present embodiment of the reproduction apparatus comprises the aforesaid third embodiments of the correction unit 330.

As shown in FIG. 18, the present embodiment of the sound signal reproduction apparatus 1100 comprises a reproduction unit 1110 including a headphone or an earphone, and a correction unit 330 for performing a correction processing on a signal in consideration of the characteristics of the reproduction unit 1110.

In the sound signal reproduction apparatus 1100 thus constructed, the correction unit 330 is operated to perform an ear canal transfer function correction processing on a sound signal inputted therein, on which a sound image localizing processing has been performed, in consideration of the variation resulted from the use of the reproduction unit 1110. The reproduction unit 1110 is operated to reproduce sounds in response to signals outputted from the correction unit 330.

As will be seen from the foregoing description, it is to be understood that the present embodiment of the reproduction apparatus is operative to perform an ear canal transfer function correction processing on a sound signal, on which a sound image localizing processing has been performed, in consideration of the variation resulted from the use of a headphone or an earphone attached to the reproduction apparatus, thereby enabling to accurately reproduce sounds collectively constituting the sound image.

Furthermore, the correction processing is performed with reference to the characteristics of the earphone or the headphone attached to the reproduction apparatus. This leads to the fact that a correction processing specified for the earphone or the headphone does not need to be selected.

Furthermore, in the sound signal reproduction apparatus according to the present invention, the third embodiment of the correction unit may be replaced by the modified third embodiment of the correction unit 410.

From the foregoing description, it is to be understood that the sound image localizing apparatus according to the present invention is operative to convert the direction into a lateral angle and a rising angle, and to convolute a sound source signal with the lateral angle control information corresponding to the lateral angle, the front direction head-related impulse response corresponding to the rising angle, and the difference information in head-related impulse response between front direction and other directions in the median plane with respect to the rising angle, thereby enabling to accurately generate a sound image localized in an arbitrarily set three-dimensional direction with a small amount of storage areas, as well as eliminate a need of measuring and generating head-related impulse responses for all the directions, which the sound image is possibly to be located. Furthermore, the sound image localizing apparatus thus constructed can reduce errors resulting from the personal difference in the head-related impulse response, and thus enhance the accuracy of localizing a sound image.

What is claimed is:

1. A sound image localizing apparatus comprising a head-related transfer function processing unit for generating sound image signals collectively constituting a sound image in response to a sound source signal to ensure that said sound image is localized in a direction selected from among a plurality of directions previously defined in three-dimensional space by lateral angles and raising angles, said head-related transfer function processing unit including:

a sound image direction setting unit for setting said selected direction;

an angle conversion unit for converting said selected direction into a lateral angle and a rising angle;

a lateral angle control information storage unit for storing lateral angle control information corresponding to said respective lateral angles;

a front direction head-related impulse response storage unit for storing a front direction head-related impulse response;

a rising angle difference information storage unit for storing rising angle difference information indicative of the difference in head-related impulse response between a front direction and other directions in median plane with respect to said rising angles; and a convolution operation unit for generating said sound image signals from said sound source signal by convolution using said lateral angle control information corresponding to said lateral angle of said selected direction, said front direction head-related impulse response, and said rising angle difference information corresponding to said rising angle of said selected direction.

2. A sound image localizing apparatus as set forth in claim 1, in which said lateral angle control information storage unit is operative to store at least one of interaural time difference information and interaural sound level difference information as said lateral angle control information.

3. A sound image localizing apparatus as set forth in claim 2, further comprising: an ear canal transfer function correction processing unit for convoluting a signal outputted from said convolution operation unit with ear canal transfer function correction data to correct an ear canal transfer function in consideration of variations resulted from a headphone or an earphone mounted on an outer ear.

4. A sound image localizing apparatus as set forth in claim 1, further comprising an ear canal transfer function correction adjusting processing unit for adjusting a signal processed by said ear canal transfer function correction processing unit in a manner of altering an ear canal transfer function to a target ear canal transfer function, in accordance with which said signal is to be processed.

5. A sound image localizing apparatus as set forth in claim 1, further comprising an ear canal transfer function correction adjusting processing unit for adjusting a signal processed by said ear canal transfer function correction processing unit in a manner of altering an ear canal transfer function to a target ear canal transfer function, in accordance with which said signal is to be processed.

6. A sound image localizing apparatus as set forth in claim 3, further comprising an ear canal transfer function correction adjusting processing unit for adjusting a signal processed by said ear canal transfer function correction processing unit in a manner of altering an ear canal transfer function to a target ear canal transfer function, in accordance with which said signal is to be processed.

7. A sound image localizing apparatus as set forth in any one of claims 1, 2, 3, 4, 5, and 6, further comprising: a head-related transfer function adjusting processing unit for adjusting a signal outputted from said head-related transfer function processing unit in a manner of altering a head-related transfer function to a target head-related transfer function, in accordance with which said signal is to be processed.

* * * * *

UNITED STATES PATENT AND TRADEMARK OFFICE

CERTIFICATE OF CORRECTION

PATENT NO. : 7,602,921 B2
APPLICATION NO. : 10/484307
DATED : October 13, 2009
INVENTOR(S) : Kazuhiro Iida and Kazuhiro Nakamura It is certified that error appears in the above-identified patent and that said Letters Patent is hereby corrected as shown below:

In Column 1, line 41 please delete "AID" and insert therefor --A/D--.

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,602,921 B2
APPLICATION NO. : 10/484307
DATED : October 13, 2009
INVENTOR(S) : Iida et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 663 days.

Signed and Sealed this

Fourteenth Day of December, 2010

David J. Kappos

David J. Kappos
*Director of the United States Patent and Trademark Office*